US012420970B2

(12) United States Patent
Westarp et al.

(10) Patent No.: US 12,420,970 B2
(45) Date of Patent: Sep. 23, 2025

(54) DISPLACEMENT DEVICE AND METHOD FOR DISPLACEMENT

(71) Applicant: HAVER & BOECKER OHG, Oelde (DE)

(72) Inventors: Christian Westarp, Oelde (DE); Renè Mackel, Diestedde (DE)

(73) Assignee: HAVER & BOECKER OHG, Oelde (DE)

( * ) Notice: Subject to any disclaimer, the term of this patent is extended or adjusted under 35 U.S.C. 154(b) by 129 days.

(21) Appl. No.: 17/998,382

(22) PCT Filed: May 11, 2021

(86) PCT No.: PCT/EP2021/062454
§ 371 (c)(1),
(2) Date: Nov. 10, 2022

(87) PCT Pub. No.: WO2021/228837
PCT Pub. Date: Nov. 18, 2021

(65) Prior Publication Data

US 2023/0242295 A1 Aug. 3, 2023

(30) Foreign Application Priority Data

May 13, 2020 (DE) ..... 102020112987.4
Dec. 14, 2020 (DE) ..... 102020133344.7

(51) Int. Cl.
*B65B 43/46* (2006.01)
*B65B 31/02* (2006.01)
(Continued)

(52) U.S. Cl.
CPC ..... *B65B 43/465* (2013.01); *B65B 31/024* (2013.01); *B65B 37/02* (2013.01); *B65B 43/16* (2013.01); *B65B 43/36* (2013.01)

(58) Field of Classification Search
None
See application file for complete search history.

(56) References Cited

U.S. PATENT DOCUMENTS 4,448,011 A 5/1984 Pohl
4,510,736 A * 4/1985 Muller ..... B65B 51/32 53/284.7
(Continued)

FOREIGN PATENT DOCUMENTS

AU 454509 B2 10/1974
DE 102007021786 A1 11/2007
(Continued)

OTHER PUBLICATIONS

International Search Report and Written Opinion received for PCT/EP2021/062454, mailed Sep. 3, 2021.
(Continued)

*Primary Examiner* — Tanzim Imam
(74) *Attorney, Agent, or Firm* — Greer, Burns & Crain, Ltd

(57) ABSTRACT

A displacement device for a handling device, having an articulation mechanism on which the handling device is accommodated, wherein the handling device is displaceable by the articulation mechanism between a first position and a second position. A pre-loading device is in operative connection with the articulation mechanism and/or the handling device to intercept the weight of the articulation mechanism and/or the handling device during displacement of the handling device between the first position and the second position. In a method for displacement of a handling device by such a displacement device, the pre-loading device unloads the weight of the handling device during displacement between the first position and the second position so that a continuous and reduced application of force moves the handling device. A packing machine for filling product like
(Continued)

bulk materials into bags includes a filling module with a filling nozzle, a displacement device and a handling device.

10 Claims, 20 Drawing Sheets

(51) Int. Cl.

| | |
|---|---|
| ***B65B 37/02*** | (2006.01) |
| ***B65B 43/16*** | (2006.01) |
| ***B65B 43/36*** | (2006.01) |

(56) References Cited

U.S. PATENT DOCUMENTS

| | | | | |
|---|---|---|---|---|
| 5,398,484 | A * | 3/1995 | Kader | B65B 43/465 198/463.3 |
| 6,295,790 | B1 | 10/2001 | McGregor et al. | |
| 6,401,439 | B1 * | 6/2002 | Tetenborg | B65B 43/465 53/567 |
| 6,474,050 | B1 | 11/2002 | Tetenborg | |
| 7,764,891 | B2 | 7/2010 | Du et al. | |
| 7,861,499 | B2 | 1/2011 | Combrink et al. | |
| 7,954,307 | B2 | 6/2011 | Paunesku et al. | |
| 9,352,860 | B2 | 5/2016 | Vollenkemper et al. | |
| 9,802,724 | B2 | 10/2017 | Vollenkemper | |
| 11,273,942 | B2 | 3/2022 | Schütte et al. | |
| 11,305,904 | B2 | 4/2022 | Gallaun et al. | |
| 2019/0300216 | A1 | 10/2019 | Nakamoto | |
| 2019/0375530 | A1 | 12/2019 | Mora Flores et al. | |
| 2020/0062429 | A1 * | 2/2020 | Felling | B65B 39/14 |
| 2020/0369417 | A1 | 11/2020 | Pieper et al. | |

FOREIGN PATENT DOCUMENTS

| | | | | |
|---|---|---|---|---|
| DE | 102008014489 | A1 | 9/2009 | |
| DE | 102011002808 | A1 | 7/2012 | |
| DE | 102013105603 | A1 | 12/2014 | |
| EP | 1857369 | A2 | 11/2007 | |
| EP | 2117781 | A1 | 11/2009 | |
| EP | 2132095 | A1 | 12/2009 | |
| EP | 3715267 | A1 | 9/2020 | |
| IT | MI20121877 | A1 | 5/2014 | |
| JP | 2002143794 | A | 5/2002 | |
| WO | WO-2018202789 | A1 * | 11/2018 | B65B 1/02 |

OTHER PUBLICATIONS

German Search Report received for 102020133483.4, dated Aug. 4, 2021.

German Search Report received for 102020112987.4, dated Feb. 19, 2021.

* cited by examiner

DISPLACEMENT DEVICE AND METHOD FOR DISPLACEMENT

BACKGROUND

The present invention relates to a displacement device for at least one handling device, in particular for a gripper device having at least one gripper arm, of a packing machine, comprising at least one articulation mechanism on which the handling device is accommodated. In this case, the handling device is displaceable by means of the articulation mechanism between at least one first position and at least one second position. The present invention additionally relates to a method for displacement of a handling device using such a displacement device. The present invention furthermore relates to a packing machine for filling product and in particular bulk material into bags which comprises at least one filling module with at least one filling nozzle and at least one such displacement device with at least one handling device.

In many machines, components and in particular tools or other processing and/or handling modules are moved to and fro between different positions in order to perform a processing and/or convey items or products from one position into another.

For example, in automatic and/or partially automatic packing machines, e.g. for filling bulk material into bags, according to the configuration, for example, an empty bag is grasped from a supply by a gripper device and attached to a filling nozzle.

Here it is the case that the device has an extremely high mass compared to empty bag being transported. As a result, the energy expenditure required for transporting the empty bag is disproportionately high.

The filled bag can then be conveyed also depending on the configuration by the gripper device, e.g. to a closure station or the like.

Depending on the configuration of the packing machine and/or depending on the arrangement of the individual assemblies with respect to one another, it is frequently necessary to displace the gripper device or the gripper arm forwards and backwards.

In particular, when the bag to be transported is filled, in some cases considerable forces act on the displacement mechanism. In this case, in particular at the end points of the movement, force maxima occur so that starting the movement requires a very high expenditure of force. The large acting forces thus result in an increased wear and relatively large motors are required for the drive.

It is the object of the present invention to improve the disadvantages described previously.

SUMMARY

The displacement device according to the invention is suitable for displacing or moving at least one handling device, in particular for displacing a gripper device having at least one gripper arm of a packing machine. In particular at least one handling device is accommodated on the displacement device. In this case, the displacement device comprises at least one articulation mechanism on which the handling device is accommodated, wherein the handling device is displaceable by means of the articulation mechanism between at least one first position and at least one second position. In this case, at least one pre-loading device is in operative connection with the articulation mechanism and/or handling device in order to intercept the weight of the articulation mechanism and/or handling device during displacement of the handling device at least partially and at least in sections between the first position [and] the second position.

Preferably the handling device is in particular a processing device such as, for example, a machine, a tool, a gripper, a handling module and/or another component.

The weight of the articulation mechanism and/or the handling device in particular is intercepted, received or unloaded by the pre-loading device, with the result that a particularly easy and smooth to and fro movement of the handling device can be achieved by means of the articulation mechanism.

Preferably the pre-loading device rests on the articulation mechanism or is connected thereto in order to intercept the force acting on the entire articulation mechanism, i.e. the force acting due to the weight of the handling device, i.e. in order to intercept the intrinsic load and the useful load, i.e. the bag weight. In other embodiments however, the pre-loading device can rest on the handling device or be fastened thereon so that the weight of the handling device and the articulation mechanism and the useful load is also intercepted or relieved.

The pre-loading device is in particular configured as a spring or spring-like or as a spring-like element, wherein in particular hydraulic and/or pneumatic pre-loading devices can expediently be used.

The pre-loading device is in particular received in an articulated manner. In this case, the pre-loading device is in particular received on both sides in an articulated manner so that this can move in a suitable manner during displacement of the handling device or the articulation mechanism. In this case, as has already been described previously, the handling device can in particular be received on one side on the articulation mechanism and/or the handling device. The other side is preferably fastened to a housing device, a side arm, a cantilever, a wall and/or a ceiling or the like.

The gripper device is preferably received via the articulation mechanism on a housing device or in the exemplary embodiments described hereinafter, on the base body or the pillar or on a frame.

A gripper device, which is understood according to the invention as a handling device, can preferably be pivoted to and fro via the articulation mechanism, wherein the weight of the gripper device and the articulation mechanism are relieved by the pre-loading device.

In advantageous further developments the maximum force of the pre-loading device additionally results in damping of the movement into the end positions, wherein the articulation mechanism would otherwise fall unbraked into the end positions. Depending on the configuration however, buffers or other stops can also be provided.

The displacement device according to the invention offers many advantages. A considerable advantage is that due to the unloading of the articulation mechanism and/or handling device by the pre-loading device, a so to speak weightless movement of the articulation mechanism and therefore of the handling device can be achieved. Thus, the handling device can be displaced by a user by hand or also by a motor particularly smoothly back from the first into the second position.

As a result, on the one hand a particularly uniform and flowing movement can be achieved which in particular is subject to a very low wear since it is not necessary to work against large forces. In addition, it is also possible to use substantially smaller motors, in particular if an automatic or motorized displacement is provided, in order to move the handling device to and fro.

This is particularly very advantageous when the displacement device is used, for example, in a machine for filling bulk materials, wherein the handling device is then, for example, configured as a gripper device for attaching empty bags and for removing filled bags from a filling nozzle. During removal of the full bag the pre-loading device not only relieves the articulation mechanism and the handling device but also the filled bag attached to the handling device so that here also a largely relieved or low-force and particularly uniform and easy movement can be accomplished.

Preferably the pre-loading device is received in an articulated manner. In this case, in particular the pre-loading device is received in an articulated manner on both sides so that a suitable movement of the articulation mechanism and/or the handling device is provided.

Preferably the pre-loading device is arranged above and/or below the articulation mechanism or the handling device so that the force is intercepted substantially from above and/or intercepted or supported from below.

Particularly preferably the displacement from the first position into the second position is accomplished substantially along an arcuate path, in particular a circular path. This can be achieved by a corresponding configuration of the articulation mechanism.

In expedient further developments the pre-loading device has the minimal effect at the apex of the arcuate path. In this case, at the apex of the arcuate path the pre-loading device is in particular relieved or substantially relieved. This can be achieved in particular by a corresponding positioning of the pre-loading device relative to the articulation mechanism and/or handling device depending on where the pre-loading device acts.

In particular, the pre-loading device is set or provided in such a manner that as a result of its own weight the handling device remains in the end positions and does not lift or is displaced back in the direction of the other position.

Preferably the pre-loading device comprises at least one pneumatic device. In particular, it is provided that the pre-loading device comprises at least one pneumatic cylinder which brings about the pre-loading.

Preferably the maximum deflection of the pre-loading device defines at least one stop for the deflection of the gripper device. In this case, for example, in the case of a spring, the travel or in the case of a pneumatic cylinder, the maximum or set maximum deflection define the end positions. As a result, the movement radius can be effectively and reliably delimited.

Depending on the configuration, buffers or the like can be additionally or exclusively used for defining the end points in which the articulation mechanism runs into the end positions or rests there.

Particularly preferably the articulation mechanism is configured in the manner of a coupling gear or coupler. As a result of such a configuration, a particularly advantageous movement sequence can be achieved in cooperation with the pre-loading device.

In expedient further developments the articulation mechanism comprises at least one four-link chain or four connector linkage. In this case, preferably at least two four-link chains or four connector linkages are provided parallel to one another, which are connected to one another. Thus, a particularly stable articulation mechanism can be provided which ensures a particularly advantageous movement sequence.

Preferably the handling device is configured as a gripper device with at least one gripper arm, wherein the gripper arm is in particular received on the gripper device in a height-adjustable manner. In this case, due to the height distribution it can be achieved in particular that bags can be attached particularly reliably to a filling nozzle and can be removed from this. In particular, depending on the configuration it is also possible, if the handling device is configured, for example, as a gripper device for gripping bags, that during movement of the articulation mechanism the bag is still initially lowered to some extent due to the inclination of the gripper and during pivoting back into the end position when the grippers are horizontal again, a vertical movement is superimposed again whereby the grippers then transfer the bag to a fixed filling nozzle.

In addition, when a handling device is configured as a gripper device with at least one gripper arm, it is provided that the pre-loading device also unloads the material conveyed by the gripper arm or by the gripper device, for example, empty and/or filled bags.

Preferably at least one actuator device is provided for displacement of the handling device or the articulation mechanism. In this case, the actuator device acts in particular on the articulation mechanism. However, it can also transfer the force to the handling device depending on which configuration is appropriate and advantageous depending on the installation situation. An automatic to and from movement of the handling device from the first position into the second position can be accomplished by a motor device for displacement of the handling device. An actuator device can in particular comprise at least one motor device or at least one motor or be provided by such. Depending on the configuration, however, the actuator device can also additionally or exclusively comprise at least one pneumatic device or at least one pneumatic cylinder or be provided thereby.

The method according to the invention is suitable for displacement of a handling device by means of a displacement device as has been described previously. In this case, the pre-loading device unloads the weight of the handling device and/or the articulation mechanism during displacement at least in sections between the first position and the second position at least partially so that a substantially continuous and reduced application of force is required to move the handling device or the articulation mechanism.

The method according to the invention also offers the advantages already explained previously. In particular, depending on the configuration it is possible to move the displacement device with less expenditure of force or even almost without force or without expenditure of force regardless of which weight is suspended on the articulation mechanism or on the handling device. Thus, in particular smaller motors can also be used for the automatic or automated displacement of the handling device or the articulation mechanism since less force is required. In addition, these are more durable since less force acts on the individual components so that, for example, the motor is subjected to less wear.

The packing machine according to the invention is suitable for filling product and in particular bulk materials into bags and comprises at least one filling module with at least one filling nozzle and at least one displacement device with at least one handling device, as has been described previously.

The packing machine according to the invention offers the advantages listed previously.

Further advantages and features of the present invention are obtained from the exemplary embodiment, which is explained hereinafter with reference to the appended figures.

DETAILED DESCRIPTION

Figure 1:
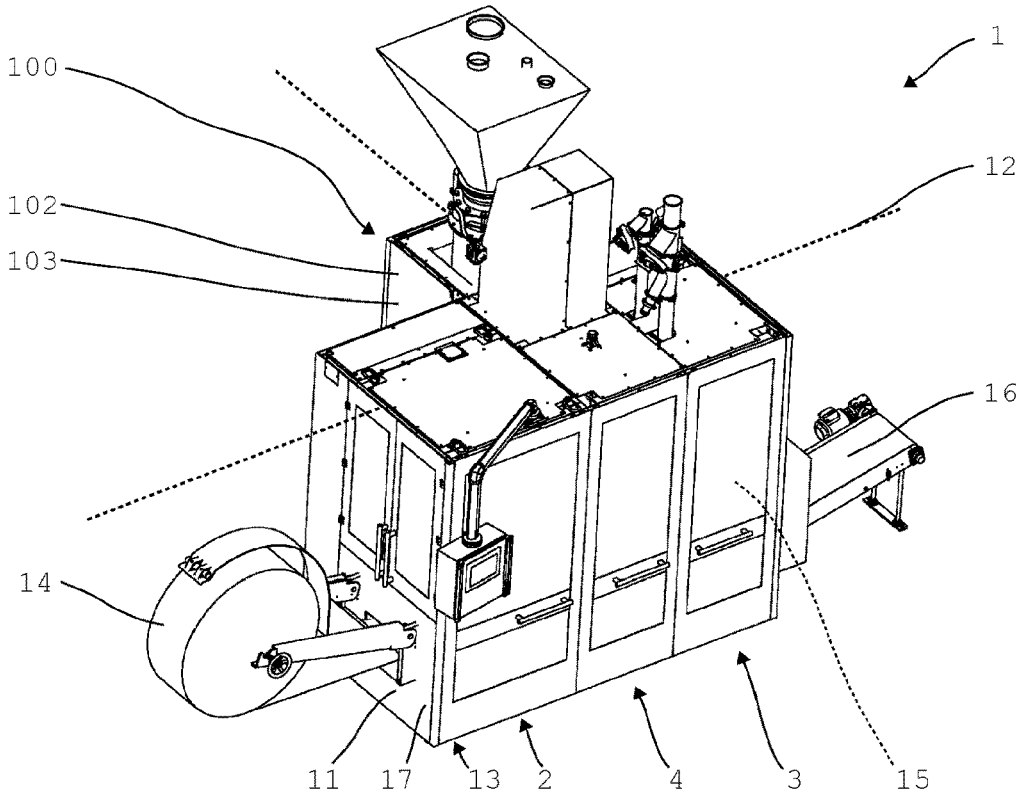
FIG. 1 shows a purely schematic diagram of an exemplary embodiment of a packing machine according to the invention in a perspective view.

FIG. 1 shows a packing machine 1 according to the invention in a perspective view. In this case, the packing machine 1 in the exemplary embodiment shown here comprises a bag supply 2, a bag removal 3 and an interposed transfer device 4. The bag supply 2, the bag removal 3 and the transfer device 4 are in this case arranged in a line 12.

A filling module 100 is provided, pulled out of line 12 and arranged in the exemplary embodiment shown here next to the transfer device 4. In the exemplary embodiment shown here, empty bags from the bag supply 2 are fed to the filling module 100 by means of the transfer device 4. The bag thus supplied to the filling module 100 is attached to the filling nozzle 101 of the filling module 100 and filled and guided by the transfer device 4 back into the line 12 and fed to the bag removal 3.

By arranging the filling module 100 next to the line or pulling out from the line, almost any filling module 100 can be used together with the modules or assemblies of the packing machine 1 arranged in the line 12. In particular, standard modules can also be used so that no special configuration of a filling module 100 must be provided for the packing machine according to the invention, preferably modules for filling open bags of any filling technology.

In the exemplary embodiment shown here, the packing machine 1 is provided encapsulated, for which the individual assemblies or modules are provided in housing devices 11, 102. In this case, in the exemplary embodiment shown here, the assemblies arranged in line 12, namely the bag supply 2, the bag removal 3 and the transfer device 4 are provided in a common housing device 11. In the exemplary embodiment shown here, the filling module 10 is provided in its own housing device 102.

By arranging the individual assemblies or modules in housing devices 11, 102, it is possible to hermetically seal off the filling process depending on the configuration so that hazardous or sensitive substances can also be filled by means of the packing machine 1. In particular, in the packing machine 1 or in the housing devices 11, 102 a vacuum can also be applied or a suction can take place so that product which escapes during filling does not escape into the environment but can be safely disposed of or even recycled.

In the exemplary embodiment shown here the bag supply 2 also comprises a bag production 13, wherein bags are produced for this purpose starting from a film supply 14 and made available to the transfer device 4.

In the exemplary embodiment shown here the bag removal 3 comprises a closing device 15, by means of which the filled and still open bags can be closed and a conveyor belt 16 for the removal of the filled and closed bags.

Since the bag supply 2, the bag removal 3 and the transfer device are arranged in a line 12 and the filling module 100 is arranged pulled out of this line 112, this results in a T-shaped arrangement of the packing machine 1 according to the invention.

As already mentioned previously, this offers many advantages. An advantage is that by juxtaposing the filling module 100 or by pulling out the filling module 100 from the line 12, almost any (standard) filling module can be used. As a result, on the one hand, existing filling modules 100 can be used. On the other hand, due to the juxtaposition a filling module can also be changed or exchanged quickly without too much effort. In known inline systems, i.e., systems in which everything is arranged in a line, for reasons of space it can be difficult to arrange the filling technology, in particular the air filling module 105 with pressure chamber 106 shown in the exemplary embodiment, in line. In addition, operability or maintainability would be more difficult.

Another advantage is that due to the T-shaped configuration or arrangement of the packing machine a particularly compact design is possible.

Figure 2:
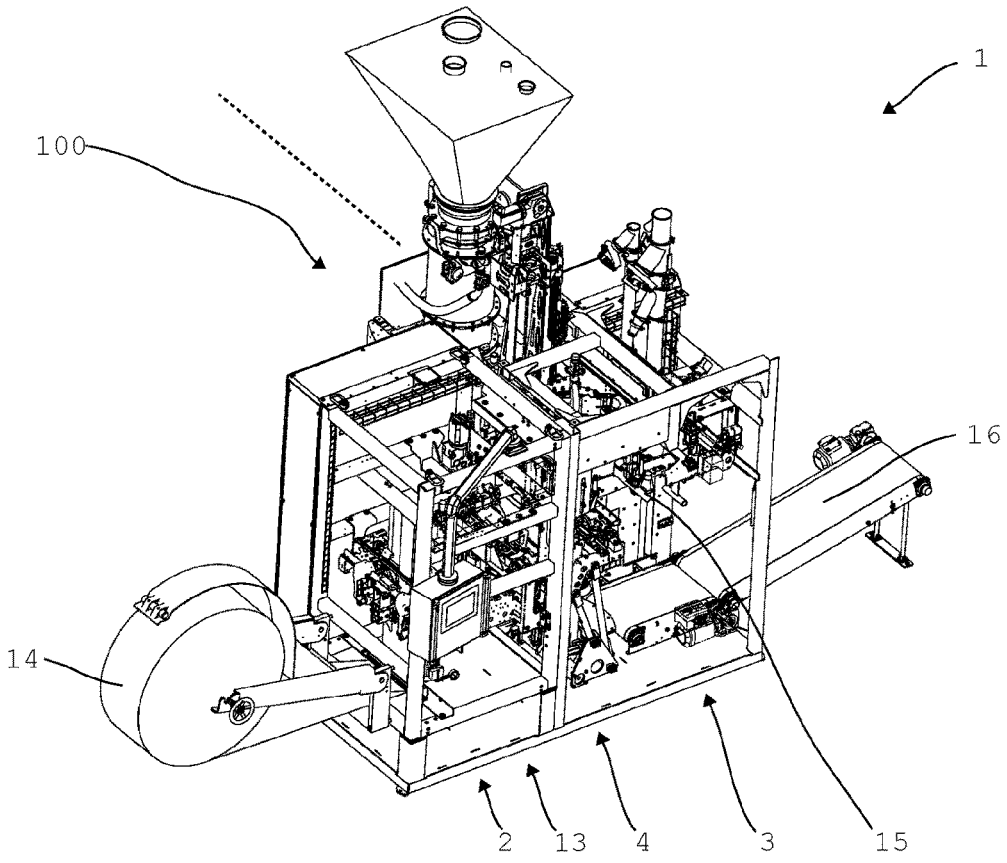
FIG. 2 shows a further purely schematic diagram of an exemplary embodiment of a packing machine according to the invention in a perspective view.
Figure 3:
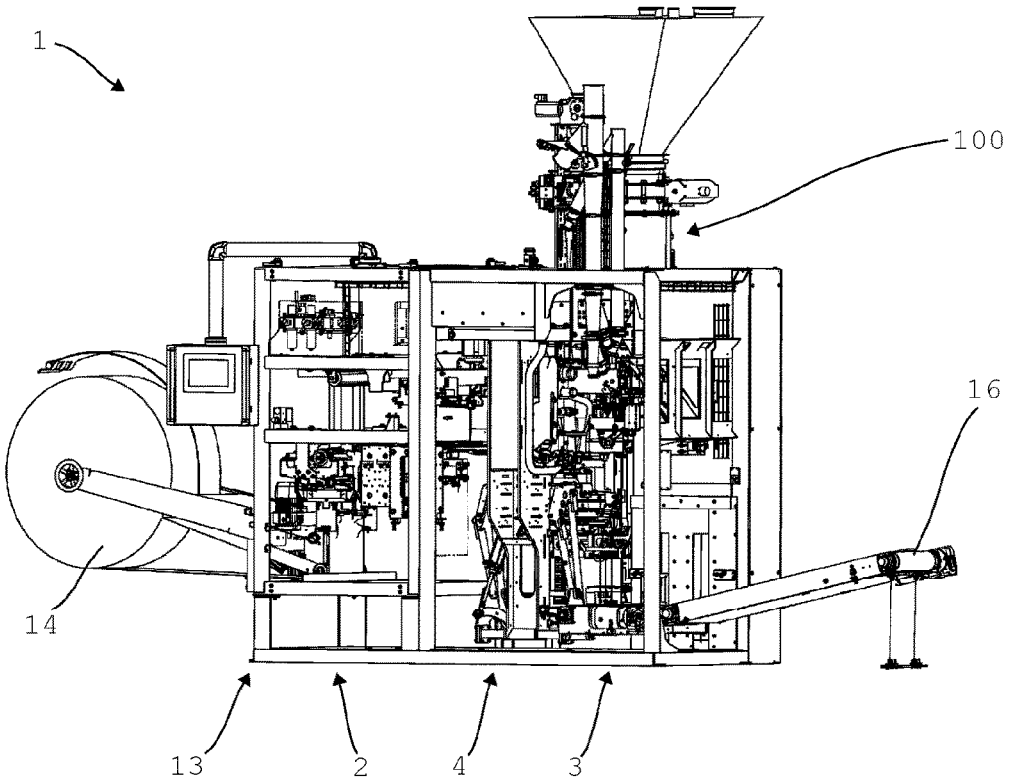
FIG. 3 shows a next purely schematic diagram of an exemplary embodiment of a packing machine according to the invention in a perspective view.
Figure 4:
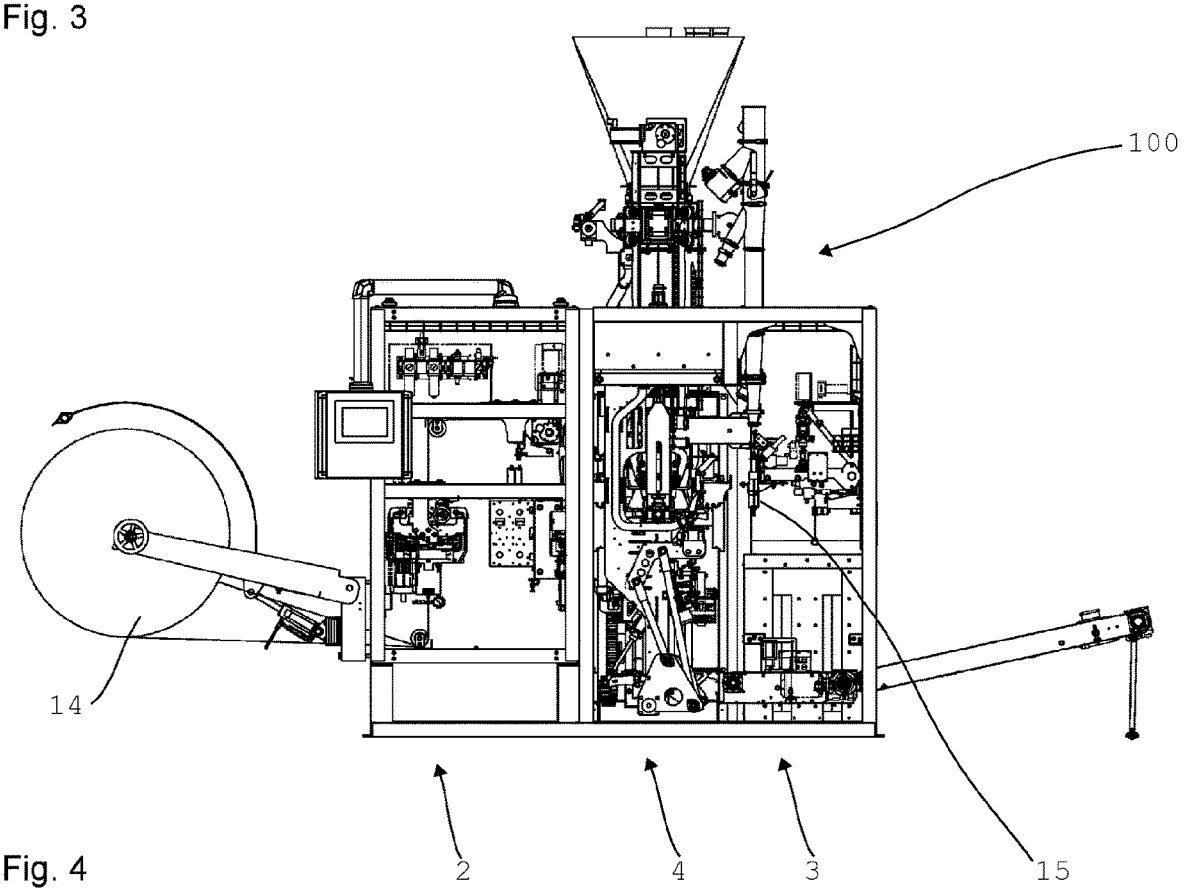
FIG. 4 shows a purely schematic diagram of an exemplary embodiment of a packing machine according to the invention in a view from the front.

For better illustration of the packing machine 1, FIGS. 2 to 4 show two perspective views and a front view of the packing machine 1, wherein in the housing devices 11, 102, the housing covers 17, 103 are not shown to provide overview views of the interior of the packing machine 1 or of the various modules or assemblies.

Figure 5:
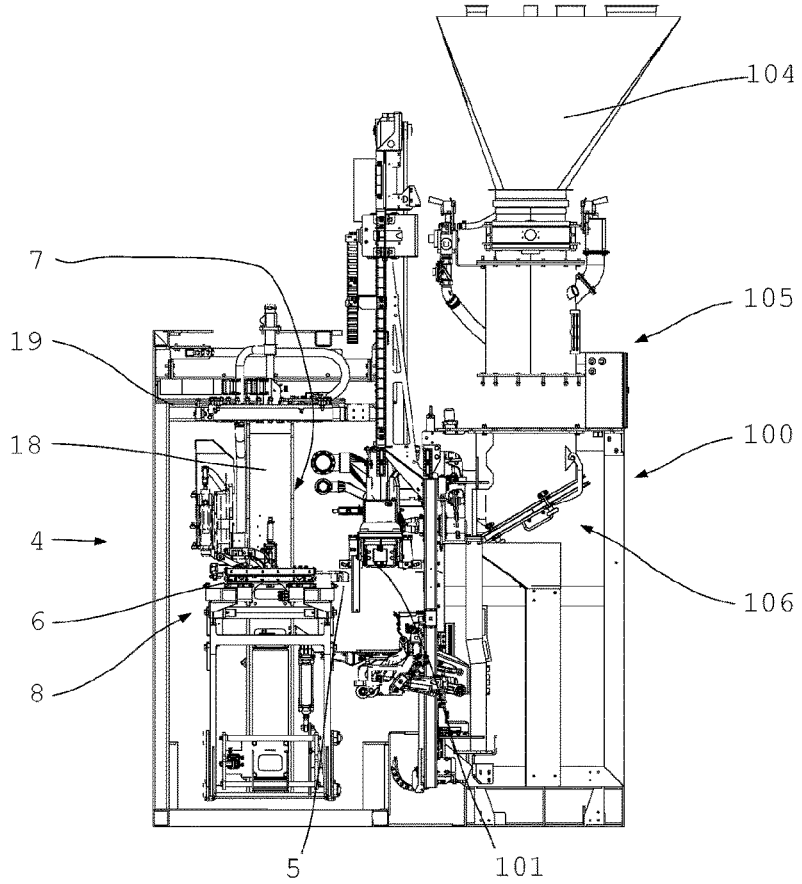
FIG. 5 shows a purely schematic diagram of an exemplary embodiment of a packing machine according to the invention in a view from the side of the bag removal.
Figure 6:
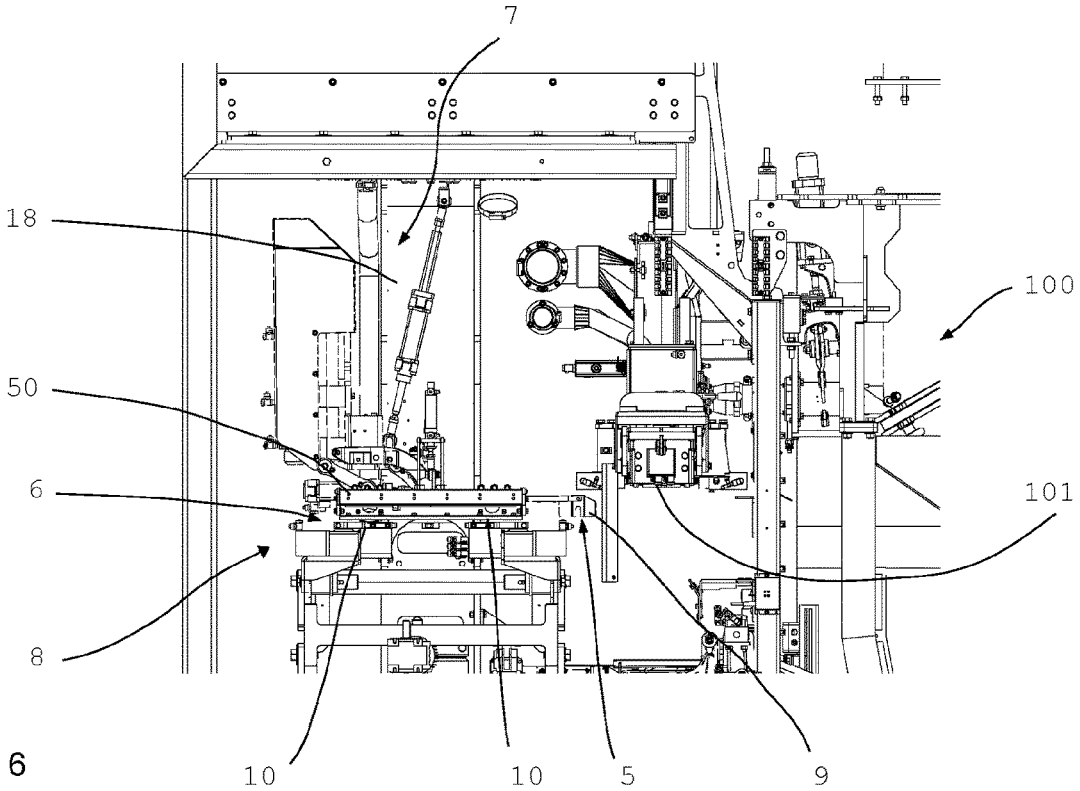
FIG. 6 shows a further purely schematic diagram of an exemplary embodiment of a packing machine according to the invention in a view from the side of the bag removal.

In FIGS. 5 and 6, the view of the transfer device 4 from the side of the bag removal 3 is shown once in an overview view and once in an enlarged diagram.

In this view, it can be seen that the filling module 100 is provided or arranged next to the transfer device 4, wherein the filling nozzle 101 of the filling module 100 can also be identified in this view. Here the inlet hopper 104 of the filling module 100 can also be seen, which is connected to a silo for product to be filled, which is located thereabove but not shown. In this case, product is fed via the inlet hopper 104 into the pressure chamber 106 inside the filling module 100 or here the air filling module 105 to the filling nozzle 101.

In this view it can be seen that the transfer device comprises a first gripper device 5 and a second gripper device 6, which are mounted on different sides 7, 8 of the transfer device 4 or on a base body 18 of the transfer device 4.

It is shown here that the base body 18 of the transfer device 4 is configured in a pillar-like manner here and is provided in a suspended manner in the exemplary embodiment shown here. In the exemplary embodiment shown, the base body 18 is suspended on rails 19, whereby the base body 19 with the gripper devices 5, 6 can be pulled out in this view to the left from the line 12. This displaceability of transfer device 4 will be shown and described in more detail later.

In addition to the displaceability of the transfer device 4 or the base body 18 of the transfer device 4, the base body 18 can also be rotated by 90° back and forth in the exemplary embodiment shown here. By turning back and forth the base body 18 of the transfer device 4 and by arranging the first gripper device 5 on one side 7 of the base body 18 and arranging the second gripper device 6 on the side 8 of the base body 18, by turning the base body 18 back and forth through 90° a bag from the bag supply 2 can be fed by means of the transfer device 4 out from line 12 to the filling module 100 or the filling nozzle 101. When the base body 18 or the transfer device 4 turns back, the second gripper device 6 comes in contact with the now filled bag at the filling nozzle 101 and can pick this up and can be guided back into the line 12 by turning forwards or re-turning the base body 18 and fed to the bag removal.

In the enlargement in FIG. 6 the first gripper device 5 and the second gripper device 6 can be identified on different sides 7, 8 of the base body 18 of the transfer device 4. One of the two gripper arms 9 of the first gripper device 5 can also be identified here.

Figure 7:
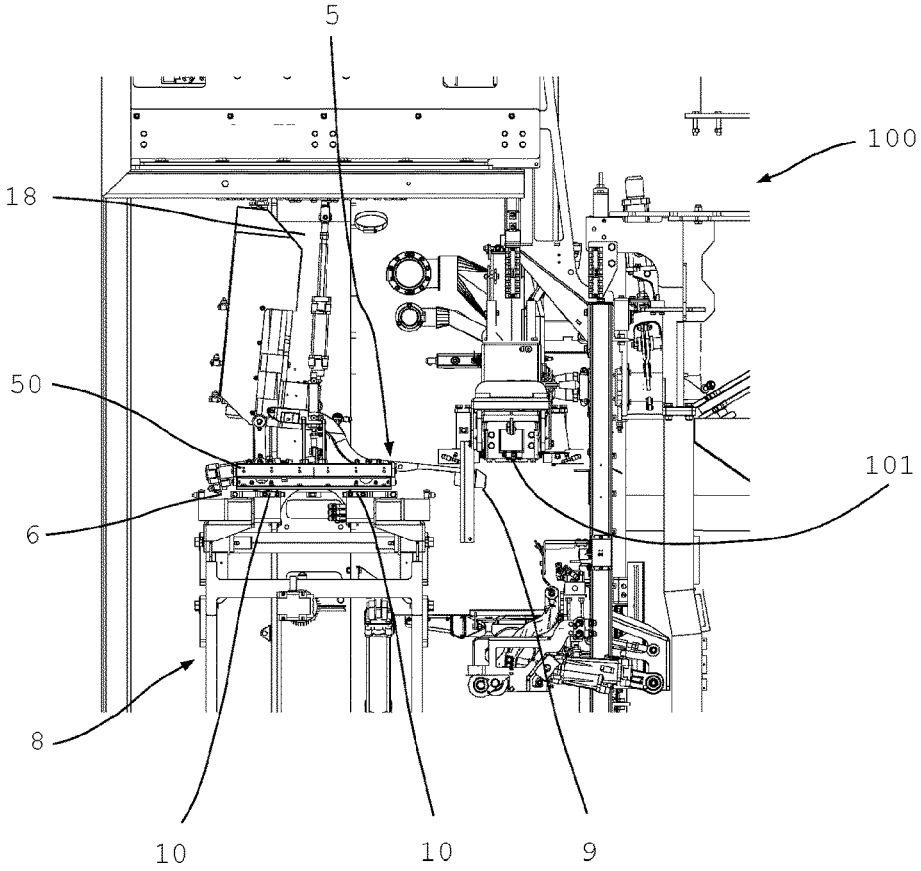
FIG. 7 shows a next purely schematic diagram of an exemplary embodiment of a packing machine according to the invention in a view from the side of the bag removal.
Figure 8:
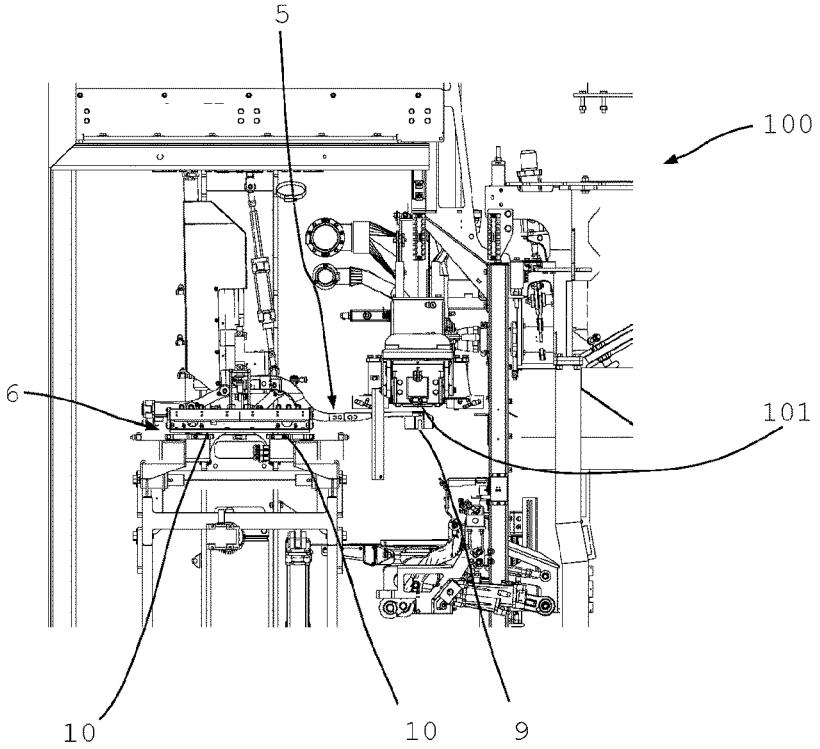
FIG. 8 shows another purely schematic diagram of an exemplary embodiment of a packing machine according to the invention in a view from the side of the bag removal.

As can be seen in more detail in the following figures, in the exemplary embodiment shown here the gripper device 5 comprises two gripper arms 9 which can be moved relative to each other so that they serve as a kind of spreader. Thus, it is possible that the gripper arms 9 of the first gripper device 5 pick up an open bag from the bag supply 2 or the bag production and attach this to the filling nozzle 101. For this purpose, the first gripper device 5 or for this purpose, the gripper arms 9 in the exemplary embodiment shown here can also be displaced forwards and pulled back again, which is shown purely schematically in FIGS. 7 and 8.

Figure 9:
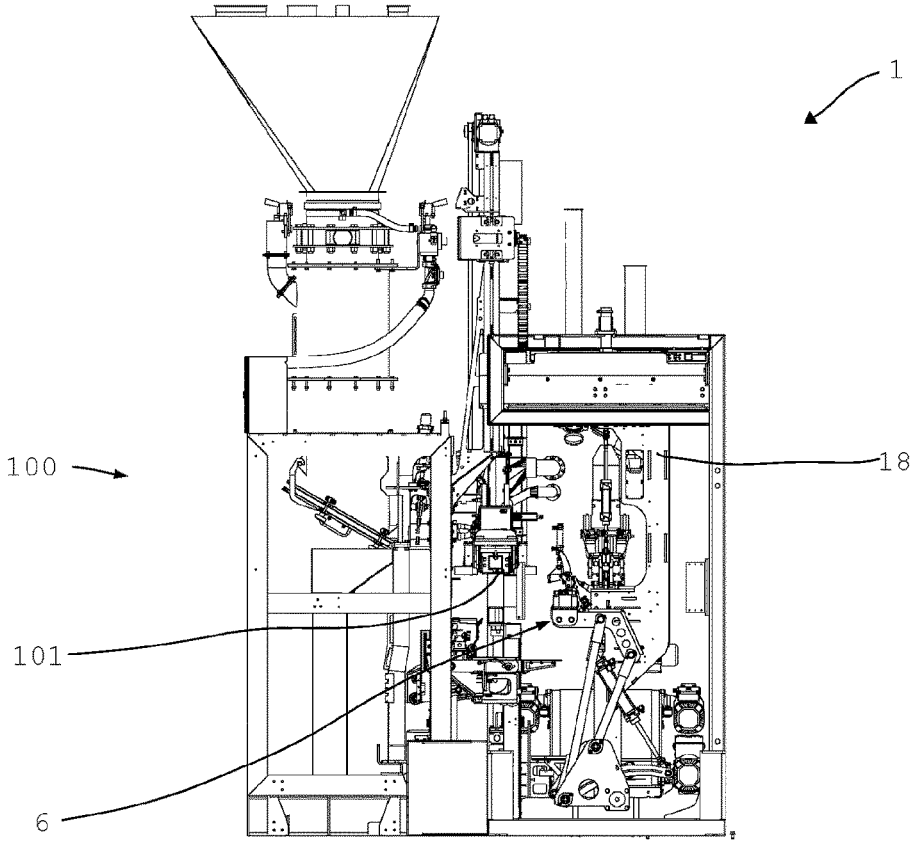
FIG. 9 shows a purely schematic diagram of an exemplary embodiment of a packing machine according to the invention in a view from the side of the bag supply.

FIG. 9 shows purely schematically the view of the transfer device 4 and the filling module 100 from the direction of the bag supply 2. In this case, the base body 18 of the transfer device 4 is rotated in such a manner that the second gripper device 6 is aligned in the direction of the filling nozzle 101 of the filling module 100. In this position, the first gripper device 5 is aligned in such a manner that it can receive an empty bag from the bag supply 2.

Figure 10:
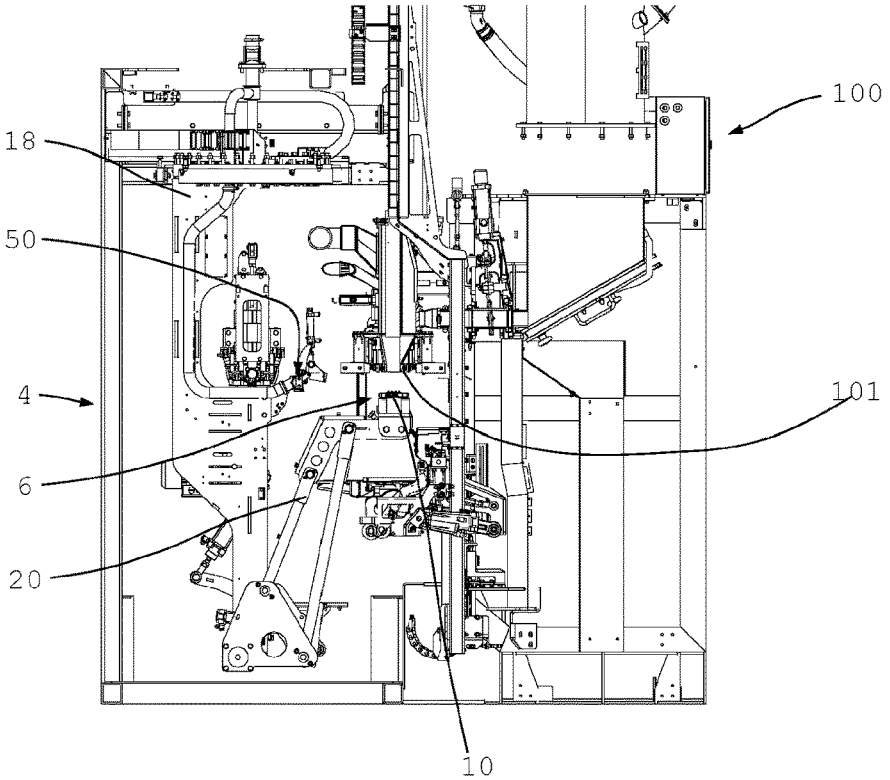
FIG. 10 shows a purely schematic diagram of an exemplary embodiment of a packing machine according to the invention in a view from the side of the bag removal.

FIG. 10 shows a purely schematic view of the transfer device 4 and the filling module 100 from the side of the bag removal 3.

Here it can be seen that the second gripper device 6 is provided to be displaceable so that the second gripper device 6 in the exemplary embodiment shown can be pivoted or displaced forwards via a parallelogram-like structure 20 in the direction of the filling nozzle 101. Thus, the clamping devices 10 of the second gripper device 6 can compress the still open bag walls of the filled bag and then displace the bag back in the direction of the base body 18.

Subsequently, the base body 18 can be rotated clockwise by 90° here so that the full bag can be displaced back into the line 12 and then fed to the bag removal. At the same time, during the removal of the full bag by the second gripper device 6, a new empty bag can be picked up by the first gripper device 5. When turning the full bag forwards into the line 12, a new empty bag is then simultaneously moved out of line 12 and fed to the filling nozzle 101.

In FIG. 10 it can also be seen that a cleaning device according to the invention 50 is provided above the second gripper device 6, which is explained in detail in the subsequent figures.

Figure 11:
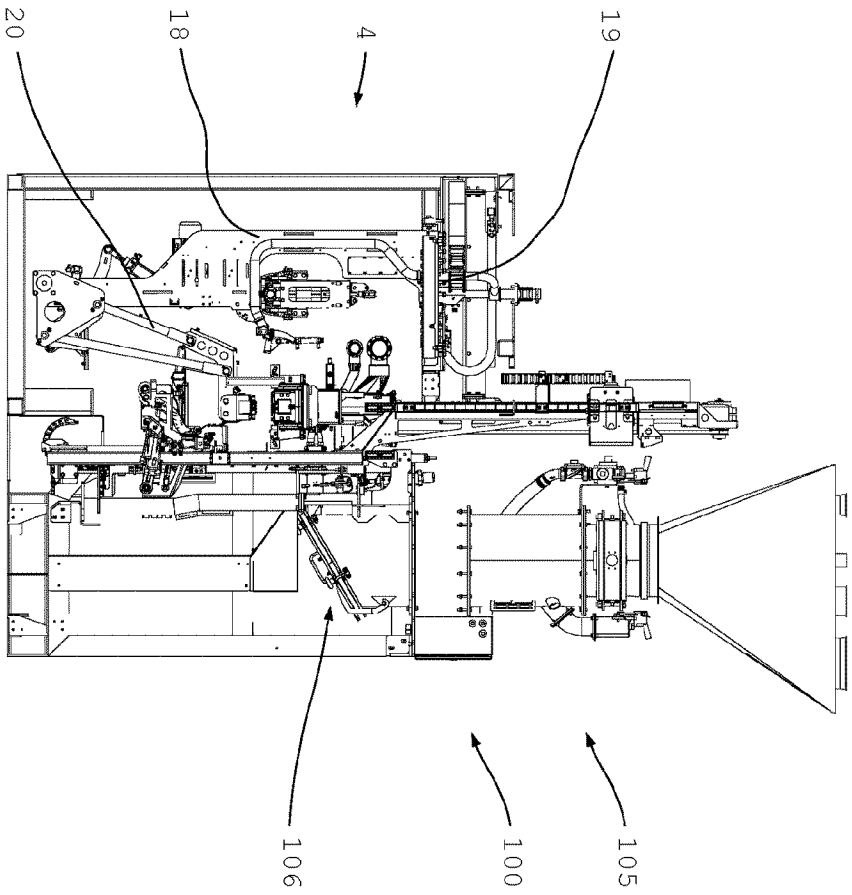
FIG. 11 shows a further purely schematic diagram of an exemplary embodiment of a packing machine according to the invention in a view from the side of the bag removal.
Figure 12:
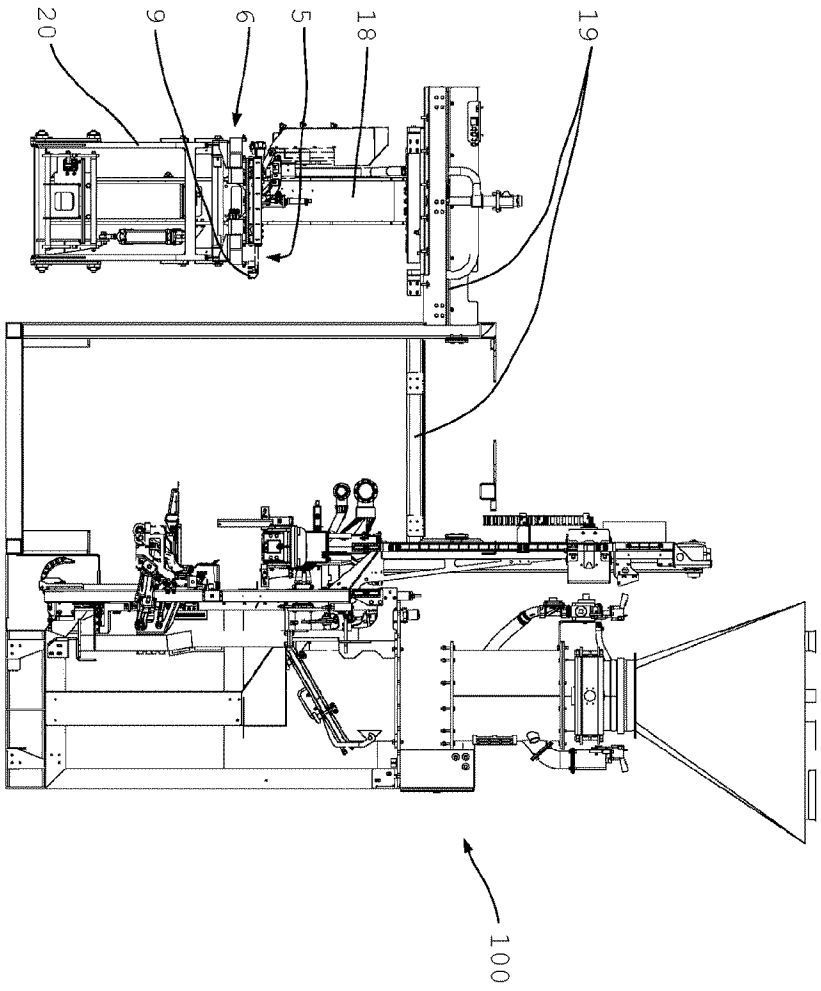
FIG. 12 shows the view according to FIG. 11 with pulled-out transfer device.

FIGS. 11 and 12 show purely schematically once again a side view of the packing machine 1 or of the transfer device 4 and the filling module 100 from the direction of the bag removal 3. When this view is compared, it can be seen that the transfer device 4 or the base body 18 together with the gripper devices 5, 6 fastened thereon is configured to be movable or extendable.

For this purpose, as already stated in the exemplary embodiment shown here, the base body 18 is suspended in an upper region and displaceable via a rail 19 or a rail system 19. Other technical components or components for displacing the base body 18 can be used analogously.

Since in the exemplary embodiment shown here, the transfer device 4 or the base body 18 of the transfer device 4 can be pulled out transversely to the line 12, for example, a sufficient space for maintenance staff is provided for maintenance of the packing machine 1.

Thus, in the extended state of the base body 18 in the exemplary embodiment shown here it is in particular possible to comfortably reach all the assemblies of the packing machine 1. In particular, the filling module 100 can be reached from the side of the filling nozzle 101. However, the bag supply 2, the bag removal and also the otherwise inaccessible side of the transfer device can be maintained and/or repaired.

Figure 13:
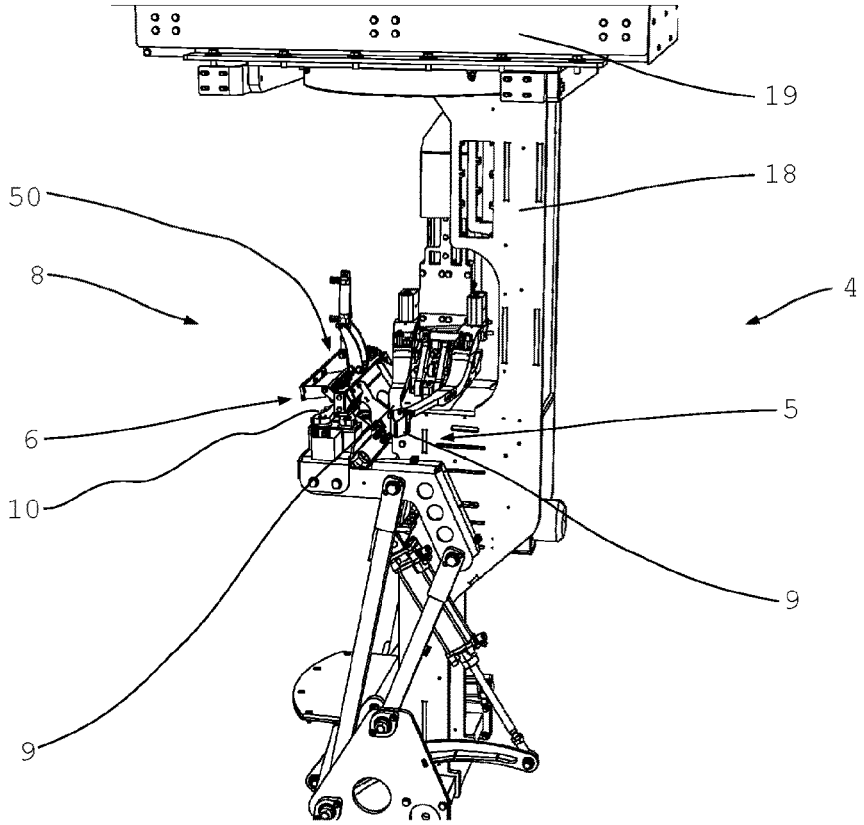
FIG. 13 shows a purely schematic diagram of an exemplary embodiment of a transfer device.
Figure 14:
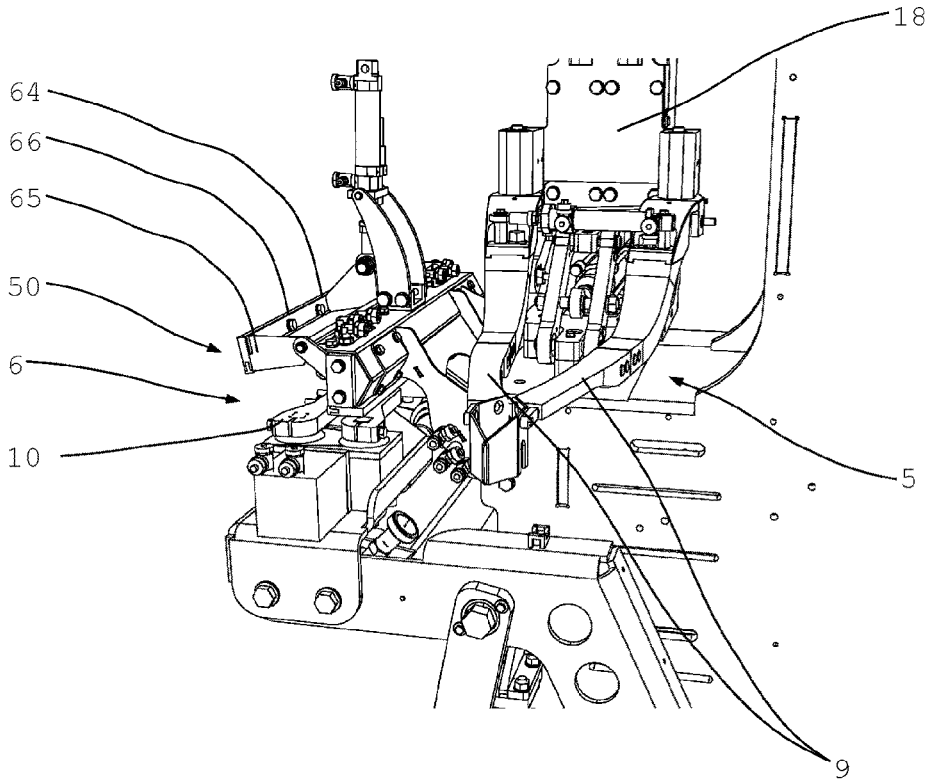
FIG. 14 shows an enlargement according to FIG. 13.

FIGS. 13 and 14 show the transfer device 4 or the base body 18 of the transfer device 4 of the packing machine 1 in an overview diagram and a detailed view.

The first gripper device 5 and the second gripper device 6 are arranged in this exemplary embodiment offset by 90° on the different sides 7, 8. As a result of this arrangement a superimposed operating mode of the empty bag and the full bag transfer or transport is ensured.

A cleaning device 50 is provided above the second gripper device 6, which comprises a housing device 64, wherein in the exemplary embodiment shown here a pivotable housing element 65 or a pivotable flap 66 is provided. The cleaning device 50 is explained in more detail in subsequent figures.

In addition, it can be seen that the first gripper device 5 is arranged on the side 7 of the base body 18, which, in the exemplary embodiment shown here, comprises two gripper arms 9, which can be moved here relative to each other or pivoted outwards or moved. Thus, the gripper arms act as spreaders and can pick up an empty bag from bag supply 2 or take it from this. Furthermore, as can already be seen previously in the figures, the first gripper device 5 is provided to be pivotable so that this can be displaced forwards in the direction of the filling nozzle 101 and also in the direction of the bag supply 2. Depending on the configuration, for example, telescopic gripper arms 9 or other components of the first gripper device 5 can be provided.

Figure 15:
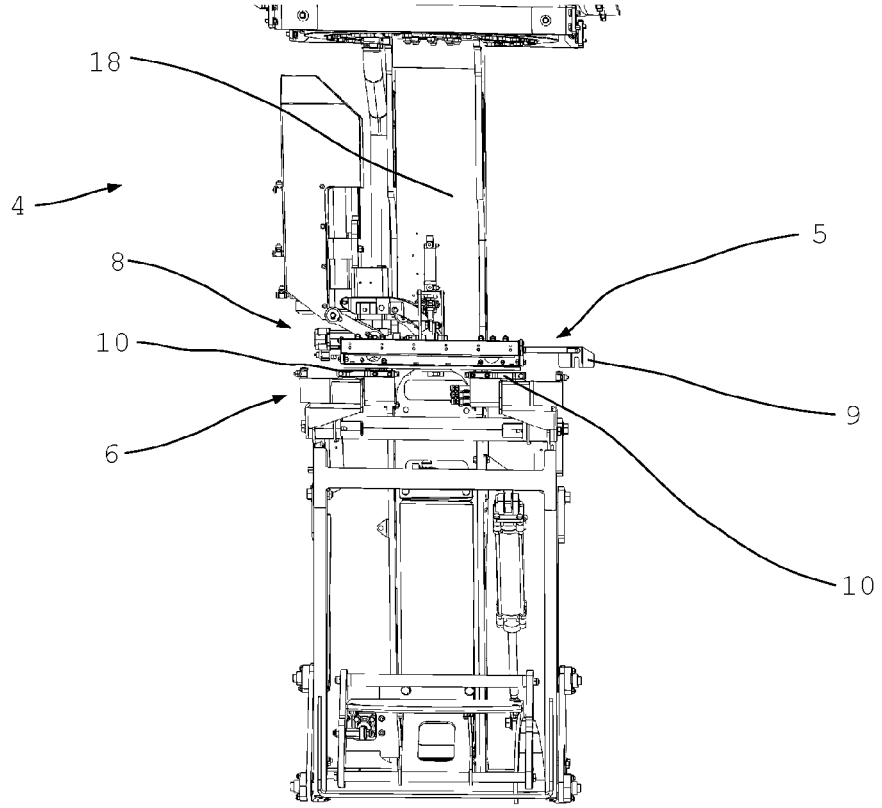
FIG. 15 shows a further purely schematic diagram of an exemplary embodiment of a transfer device.
Figure 16:
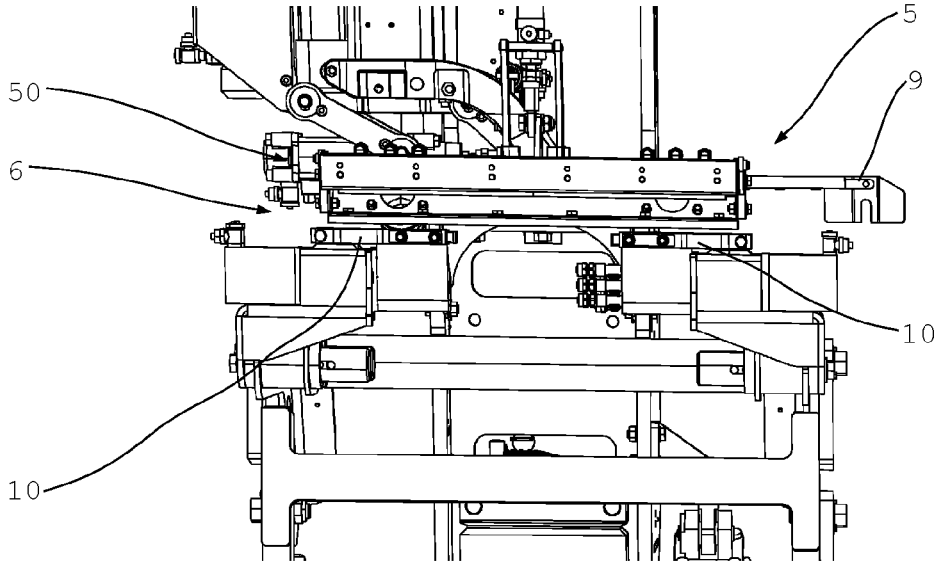
FIG. 16 shows an enlargement according to FIG. 15.

In FIGS. 15 and 16, the base body of the transfer device 4 is rotated in such a manner that the first gripper device 5 is aligned in the direction of the filling nozzle 101 of the filling module 100. In this position, an open bag not shown is held on the gripper arms 9 in the exemplary embodiment shown here by spreading the two gripper arms 9, wherein the gripper device 5 is displaced forwards to attach the bag which is held open to the filling nozzle 101. In addition, the second gripper device 6 with the clamping devices 10 can be identified.

Figure 17:
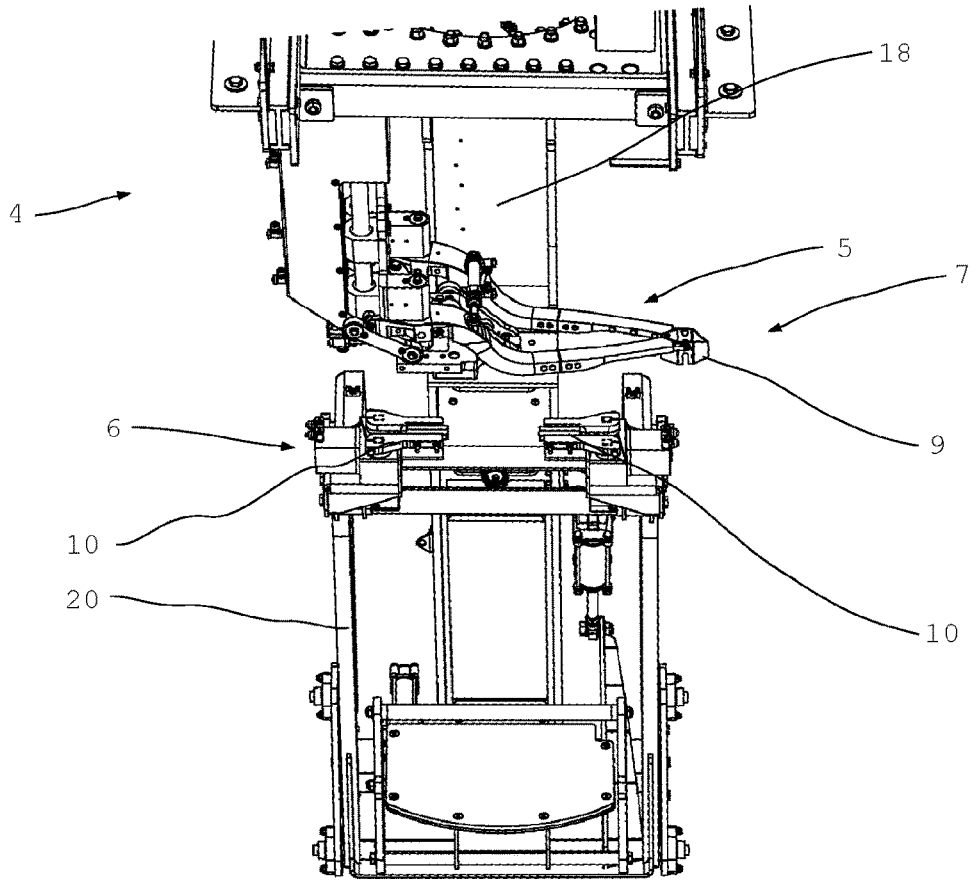
FIG. 17 shows a perspective view according to the view from FIG. 15.
Figure 18:
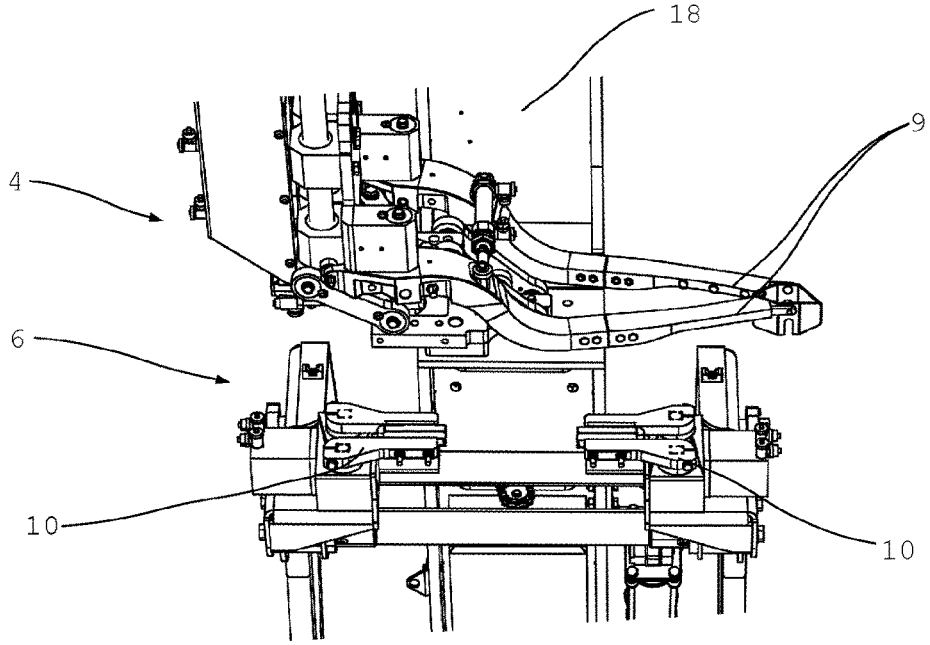
FIG. 18 shows an enlargement according to FIG. 17.

FIGS. 17 and 18 show the side view from FIGS. 15 and 16 again in a slightly perspective view from obliquely above, wherein in addition the cleaning device 50 above the second gripper device 6 is hidden in order to get a better impression of the clamping devices 10 of the second gripper device 6.

In FIGS. 19 to 24, the cleaning device 50 according to the invention provided above the second gripper device 6 in the exemplary embodiment shown here and its mode of operation is described in detail.

In this case, the cleaning device 50 according to the invention in the exemplary embodiment shown here is provided for cleaning the so-called head seam area of a bag to be closed by means of blown out air.

In addition to the application of the cleaning device 50 presented here, this can also clean any other work section, in particular in relation to the packing machine 1 described here.

Figure 19:
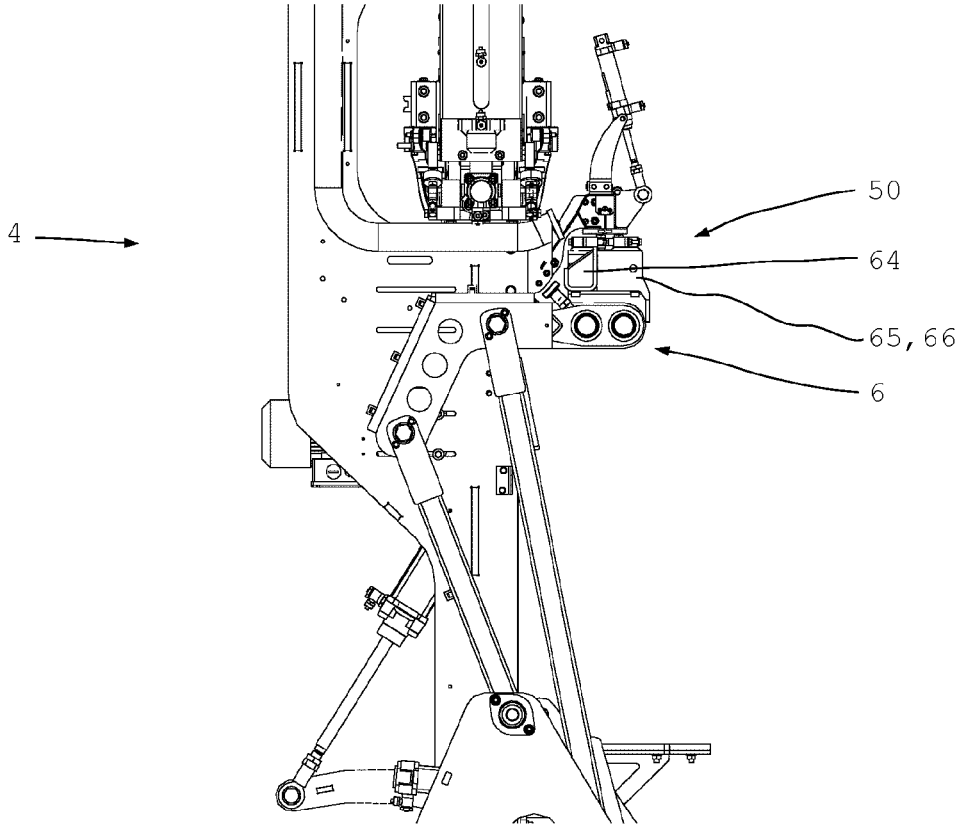
FIG. 19 shows a purely schematic view of an exemplary embodiment of a transfer device with a cleaning device according to the invention.

FIG. 19 shows an overview view of the transfer device 4 of the packing machine 1 according to the invention purely schematically, wherein in the exemplary embodiment shown here the cleaning device 50 according to the invention is arranged above the second gripper device 6.

In this exemplary embodiment, the cleaning device 50 comprises two blowing strips 51 which cannot be seen in FIG. 19. The cleaning device 50 is provided encapsulated in the exemplary embodiment shown here namely in a housing device 64. This makes it possible to achieve a hermetic sealing of the blowing strips 51 and the work section to be cleaned. In order to feed the work section to be cleaned or the bag to the cleaning device 50, the housing device 64 comprises a movable or, in this case, pivotable housing element 65 or a flap 66, which is shown in the closed state in the view shown.

Figure 20:
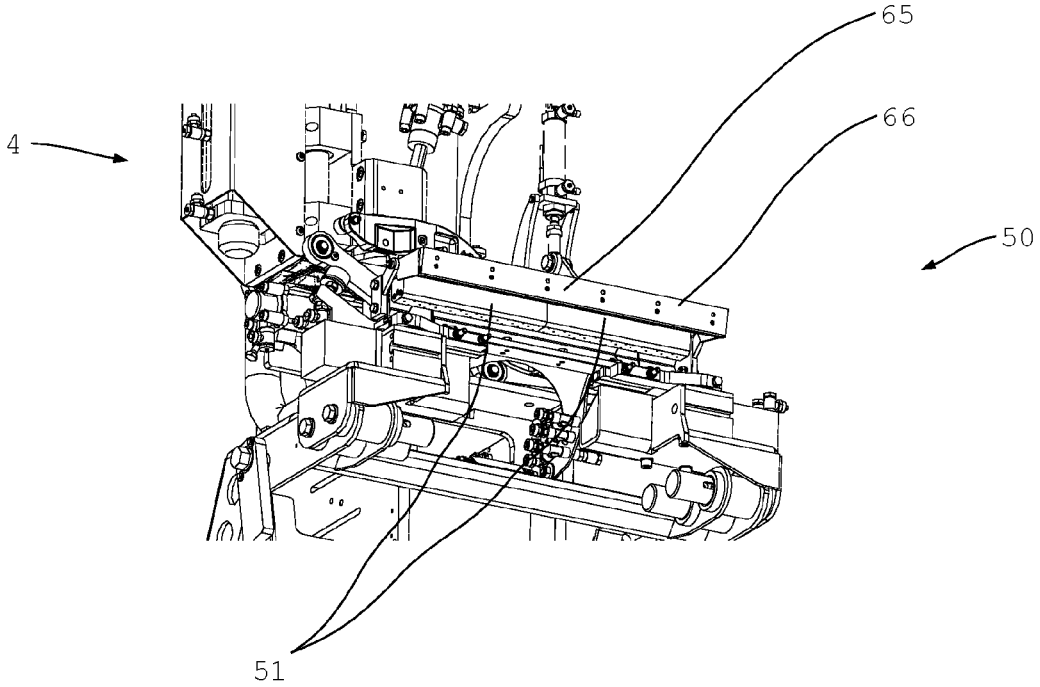
FIG. 20 shows a purely schematic diagram of a cleaning device according to the invention in a perspective view.

FIG. 20 shows in a perspective view a cleaning device according to the invention 50, wherein the movable housing element 65 or the flap 66 is shown in the open state. Thus, the view of the two blowing strips 51 located inside the housing device 64, shown here as an example, is free.

Figure 21:
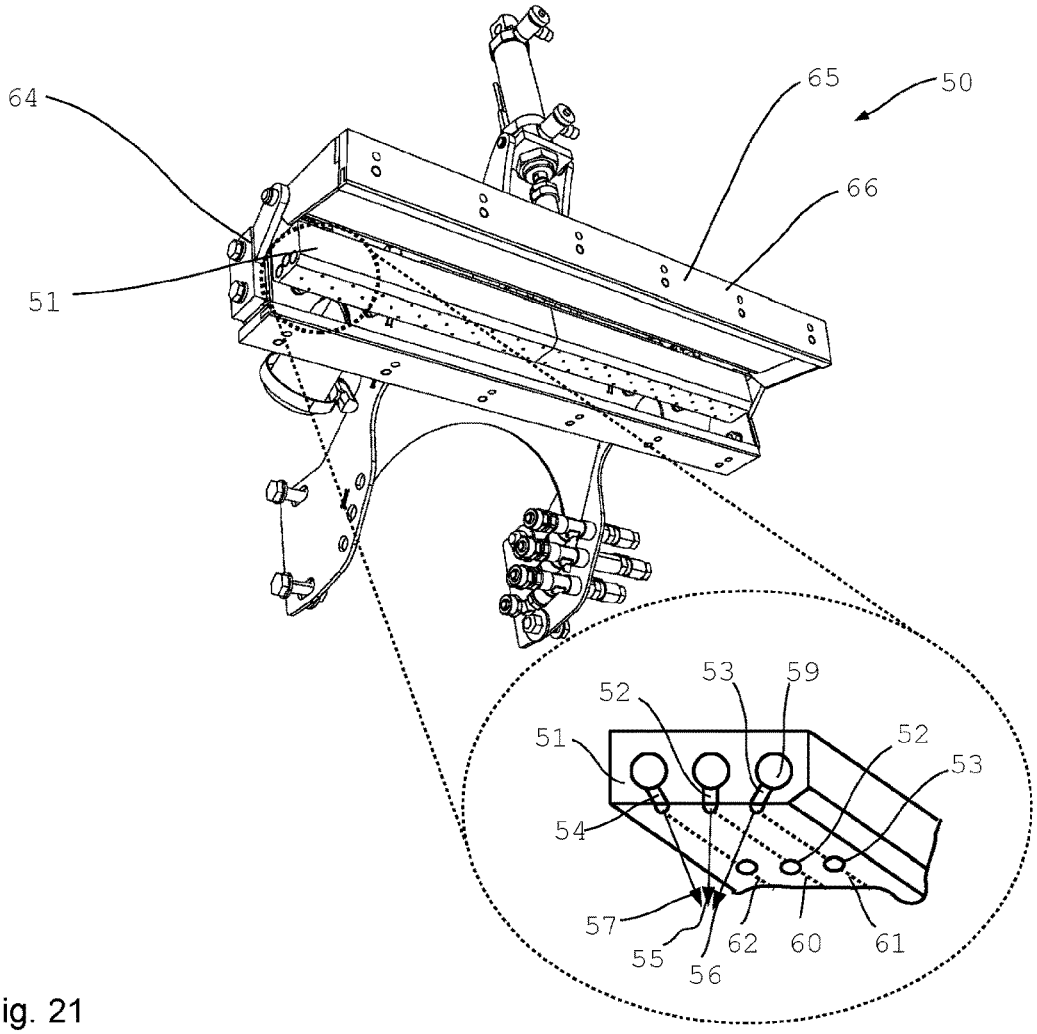
FIG. 21 shows a further purely schematic diagram of a cleaning device according to the invention in a perspective view.
Figure 22:
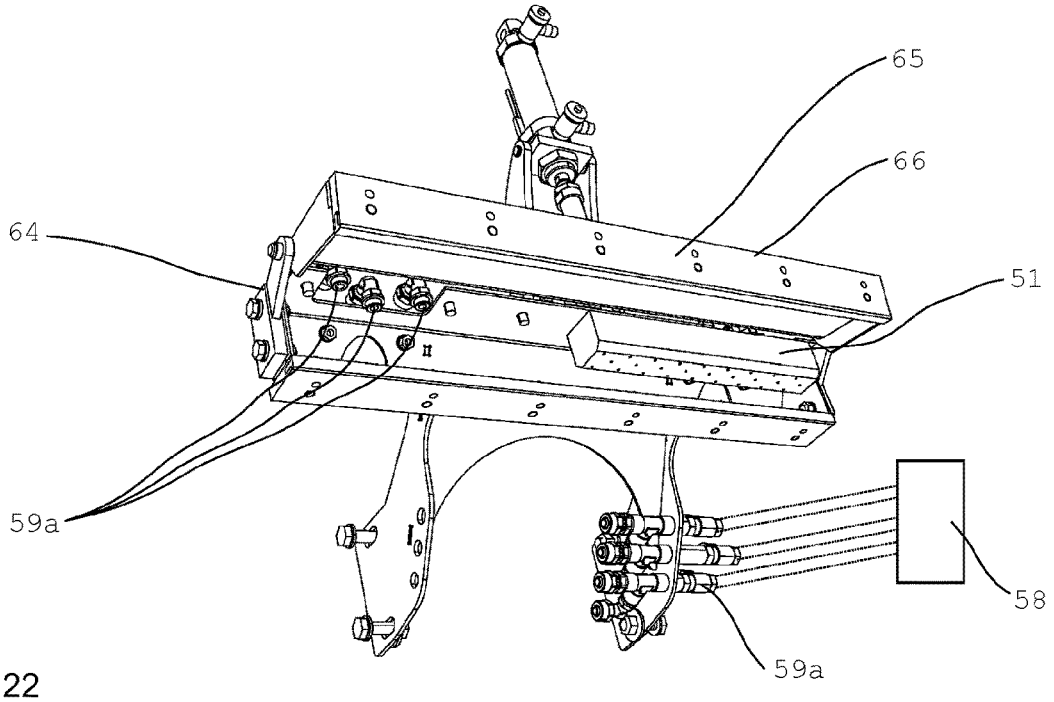
FIG. 22 shows a next purely schematic diagram of a cleaning device according to the invention in a perspective view.

In FIG. 21 in a perspective view, the assembly of the cleaning device 50 is shown separately in a perspective view. Here also, the flap 66 or the pivotable housing element 65 is shown in the open state, so that the two blowing strips 51 provided in the exemplary embodiment shown here can be seen.

In the exemplary embodiment shown here, the blowing strips 51 each comprise a plurality of first nozzle devices 52, second nozzle devices 53 and third nozzle devices 54, which are arranged here in rows 60, 61, 62.

In this case, the three rows 60, 61, 62 of the first nozzle devices 52, the second nozzle devices 53 and the third nozzle devices 54 can be supplied differently with air so that a moving air wave is blown out over the work section to be cleaned.

This is achieved whereby the first nozzle devices 52 or the first row 60 of first nozzle devices 52 each have a first blowing-out direction 55, which differs from the blowing-out directions 56, 57 of the other nozzle devices 53, 54 or rows 61, 62 of nozzle devices 53, 54. In particular, it is preferred and also provided in this exemplary embodiment that the first nozzle devices 52, the second nozzle devices 53 and the third nozzle devices 54 each have a blowing-out direction 50, 56, 57, which each differ from one another.

Furthermore, a control device 58 not shown in more detail in the figures is provided, which is suitable and configured to control the nozzle devices 52, 53, 54 at least at times in a temporally staggered manner For this purpose, it is provided in the exemplary embodiment shown that for the three rows 60, 61, 62 of nozzle devices 52, 53, 54 separate air supplies 59 are provided in each case within the blowing strips 51. This is provided here for both blowing strips 51 and can be identified in FIG. 22 purely schematically by hiding the left blowing strip 51. By hiding the one blowing strip 51 the separate air supplies 59*a* or the connections for the air supplies 59 of the blowing strip 51 located outside the blowing strip 51 can be seen.

Figure 23:
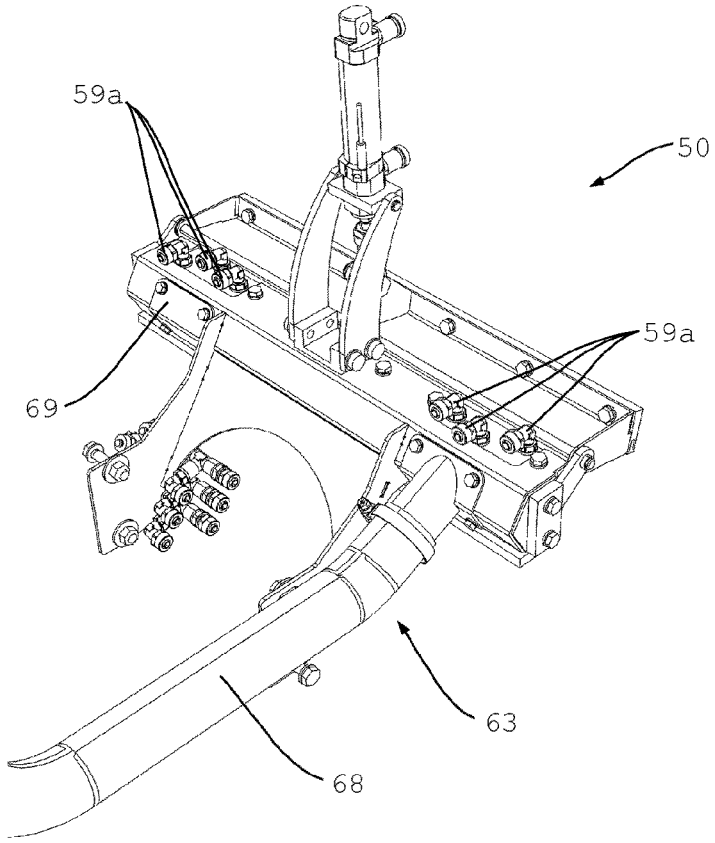
FIG. 23 shows another purely schematic diagram of a cleaning device according to the invention in a perspective view.
Figure 24:
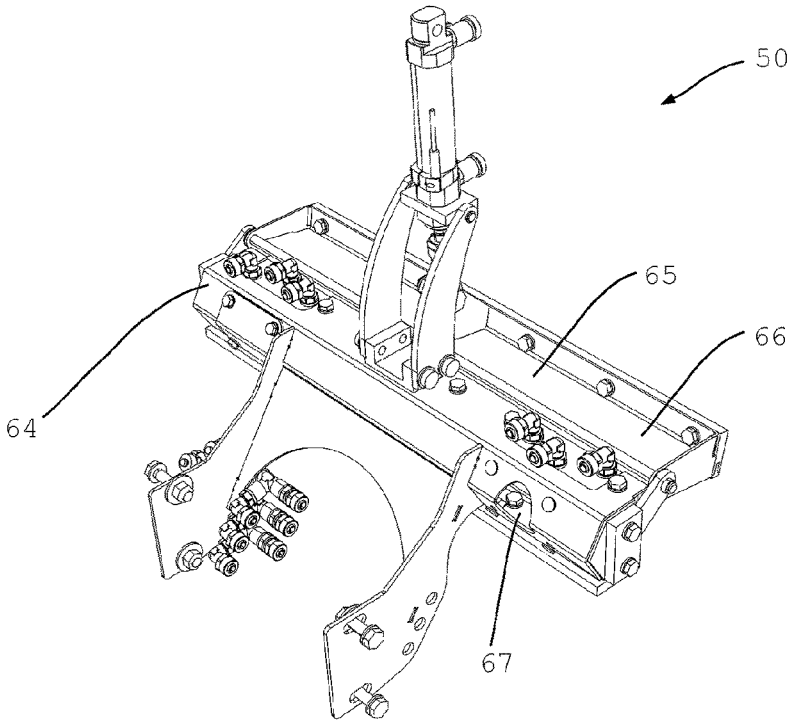
FIG. 24 shows a further purely schematic diagram of a cleaning device according to the invention in a perspective view.
Figure 25:
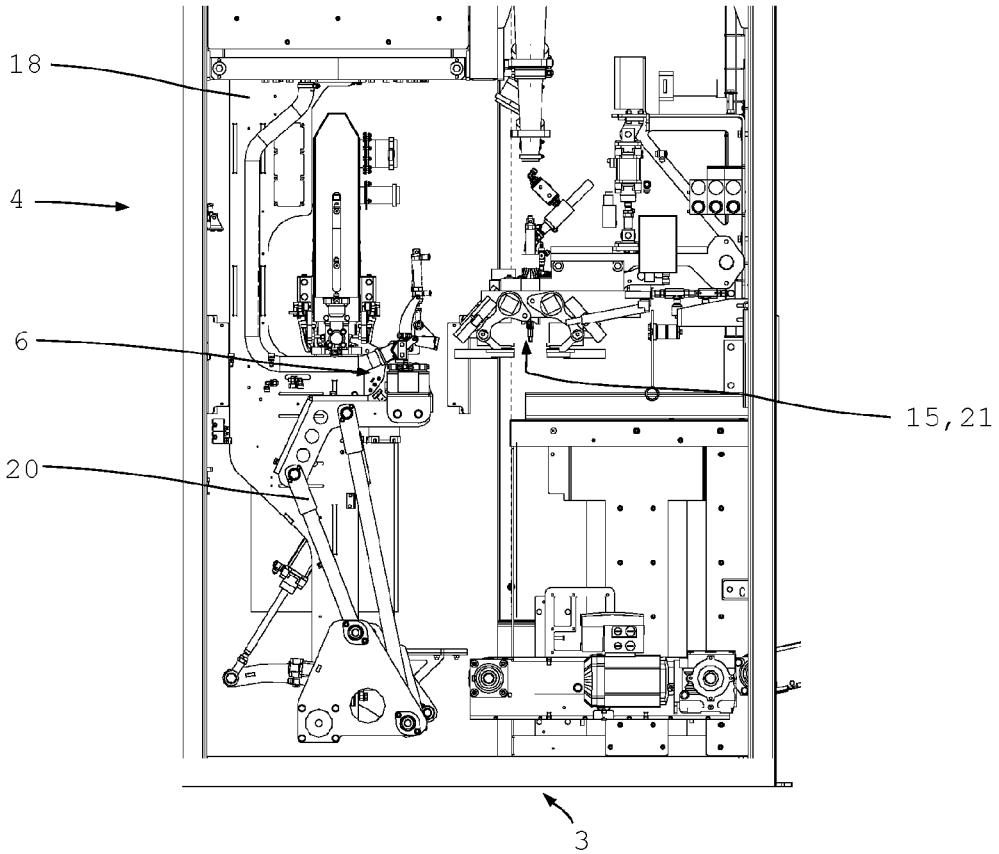
FIG. 25 shows a purely schematic diagram of an exemplary embodiment of a transfer device and a bag removal in a front view.
Figure 26:
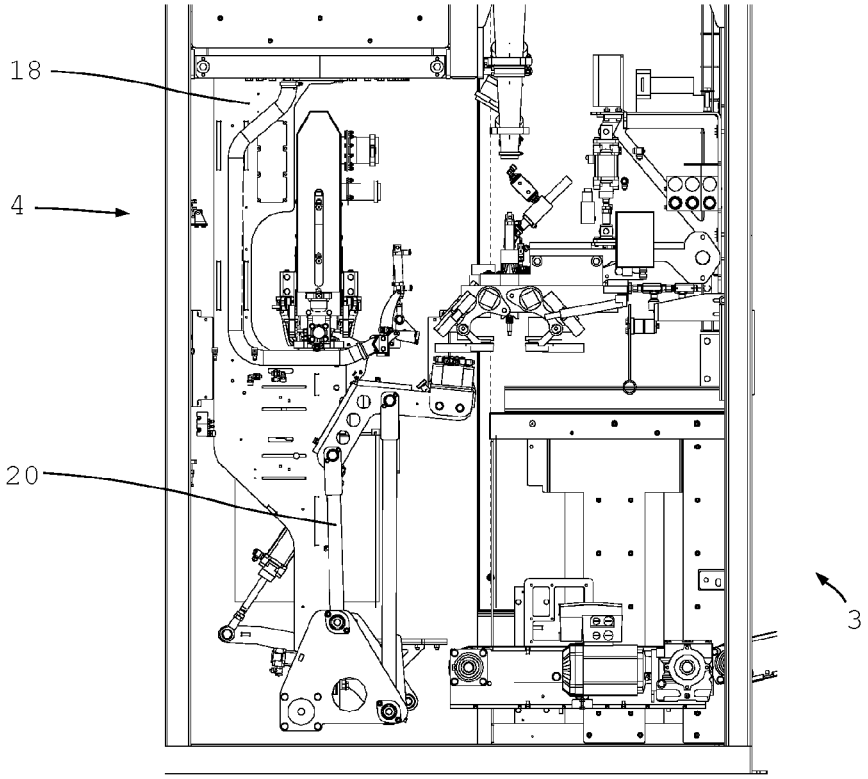
FIG. 26 shows a further purely schematic diagram of an exemplary embodiment of a transfer device and a bag removal in a front view.
Figure 27:
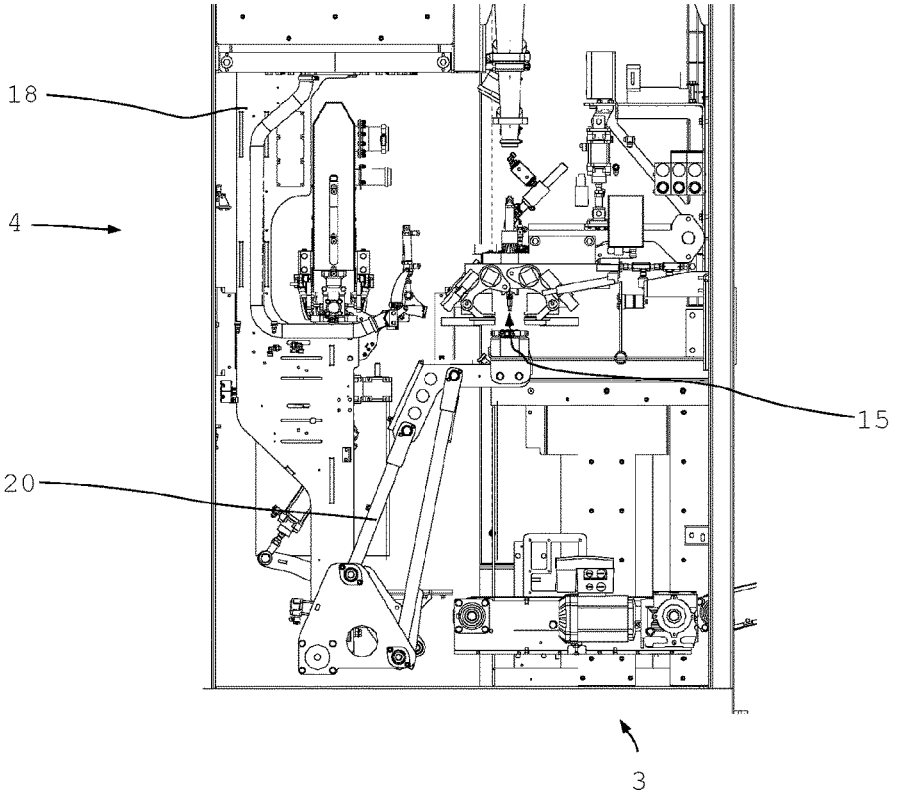
FIG. 27 shows a next purely schematic diagram of an exemplary embodiment of a transfer device and a bag removal in a front view.

FIGS. 23 and 24 show purely schematically that an extraction device 63 can also be provided to extract the air expelled by the blowing strips 51 or another fluid together with the swirled particles.

For this purpose, in the exemplary embodiment shown here the extraction device 63 is in operative connection with the interior of the housing device 64 via an opening 67 in the housing device 64.

In the exemplary embodiment shown, a suction pipe 68 is provided, which is connected to this opening 67. Depending on the configuration, for example, a further suction pipe 68 can be provided on the left side, wherein here the opening 67 is closed on the left side by a cover 69.

In the exemplary embodiment shown, as has already been described previously, it is provided that a hermetically substantially sealed cleaning space is created by closing the movable housing element 65 or the flap 66 of the housing device 64. Depending on the application, the extraction device is then set so that at least the air volume or generally the volume which is blown into the housing 64 through the blowing strips 51 is extracted. In particular, it is preferred that at least so much is extracted that at least a small vacuum is created inside the housing device 64. This is particularly important for systems that are used in dust explosion areas. In non-critical working environments or in general, a non-hermetically closing housing device 64 or even no housing device 64 can be provided.

In FIGS. 23 and 24 it can also be seen once again that the different rows 60, 61, 62 of the first, second and third nozzle devices 52, 53, 54 are connected via different air supply lines 59*a* per blowing strip 51.

Thus, the different control of the individual nozzle devices 52, 53, 54 or the individual rows 60, 61, 62 of these nozzle devices 52, 53, 54 is also possible differently per blowing strip 51. Thus, in the exemplary embodiment shown, an air wave or a moving air stream can be generated over the entire length and also over the width of the work section to be cleaned, whereby in particular the outlet pattern of a pendulum nozzle is modelled without using moving parts. In this case, in the blow-out pattern of a pendulum nozzle it is achieved that when cleaning the bag section for the subsequent head seam, the bag walls to be joined subsequently are blown apart so that product located between the bag walls is removed.

In particular, by means of an oscillating air jet it is achieved that when cleaning the bag mouth edge before closing or welding the filled bag by the moving air flow, the bag walls or film layers located on top of one another are opened by the acting air jet, so that the air jet impinges upon the inner surfaces, whereby the adhering dust or dirt particles are removed here. By changing the air jet, the layers of the side folds are also separated from each other with a corresponding design of the bag, so that this area is also cleaned. The individual film layers are as it were opened one after the other by the moving or oscillating air flow and cleaned by the air flow thus penetrating.

In FIGS. 25 to 28, the transfer of a filled bag by the transfer device 4 to the bag removal 3 is shown purely schematically.

In this case, a parallelogram-like structure 20 is provided, on which the second gripper device 6 with the clamping devices 10 is provided. This structure 20 is also used to remove the full bag from the filling nozzle 101 or to bring the second gripper device 6 into contact with the filled bag.

In the basic state, the second gripper device 6 abuts relatively closely against the base body 18 of the transfer device 4. In the following FIGS. 26 and 27 it can be seen how the second gripper device 6 moves forward in the direction of the bag removal 3 by displacing the parallelogram-like structure 20.

In this case, the closure device 15 can also be seen here, which is configured as a welding station 21 in the exemplary embodiment shown here.

Figure 28:
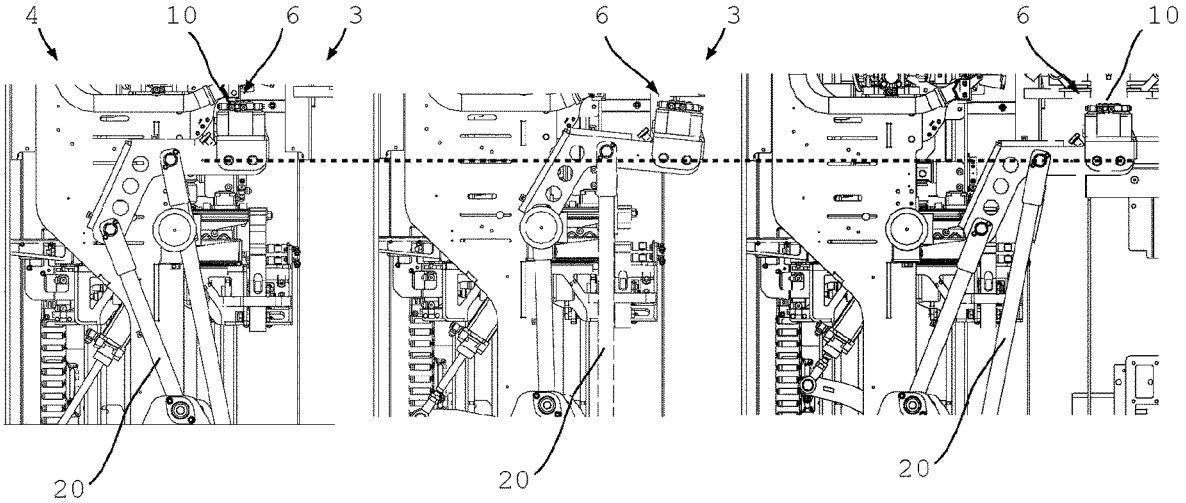
FIG. 28 shows sections from FIGS. 26, 27 and 28.
Figure 29:
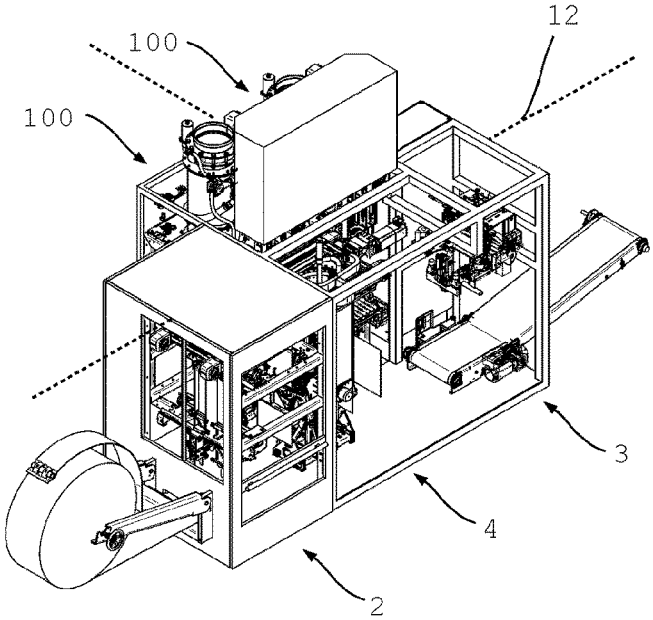
FIG. 29 shows a next exemplary embodiment of a packing machine according to the invention in a perspective view.
Figure 30:
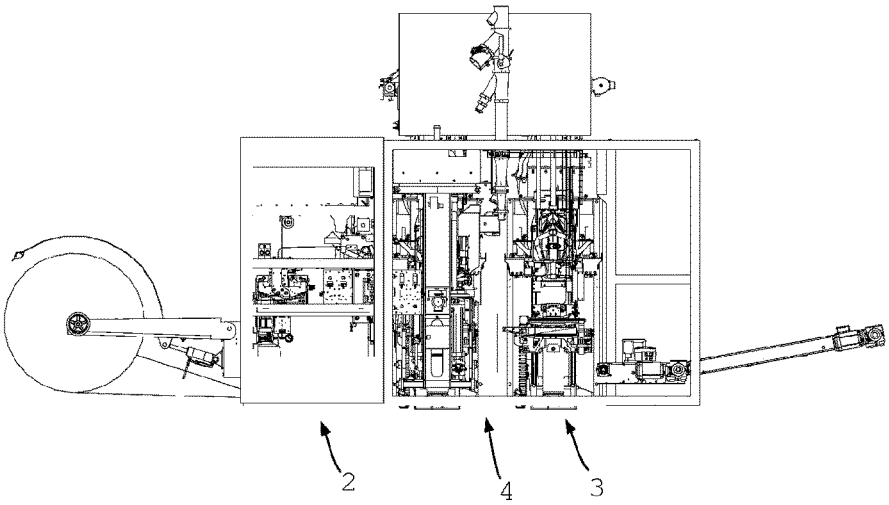
FIG. 30 shows the exemplary embodiment according to FIG. 29 in a front view.
Figure 31:
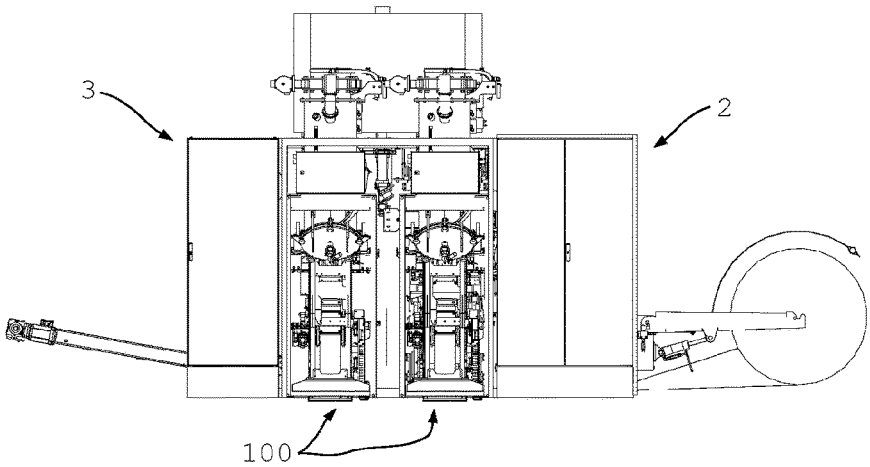
FIG. 31 shows the exemplary embodiment according to FIG. 29 in a rear view.
Figure 32:
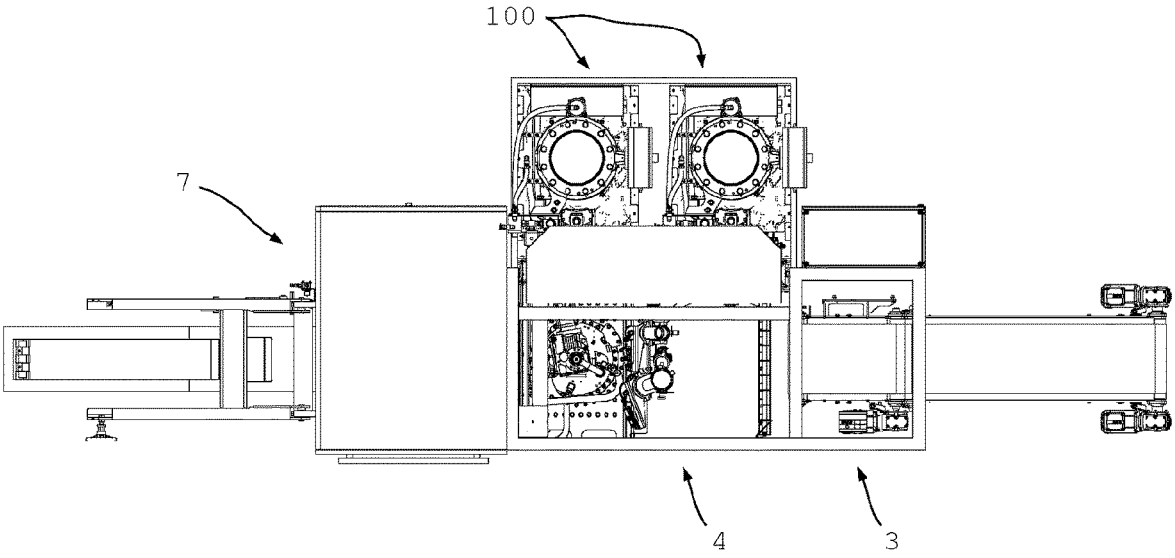
FIG. 32 shows the exemplary embodiment according to FIG. 29 in a plan view.
Figure 33:
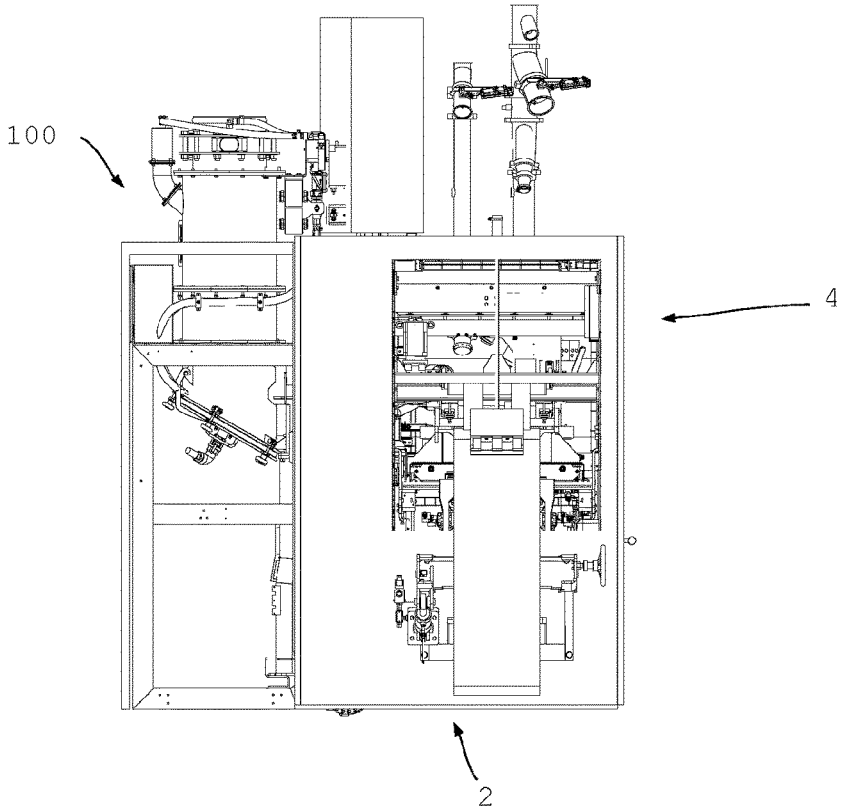
FIG. 33 shows the exemplary embodiment according to FIG. 29 in a side view.

FIG. 28 shows purely schematically by the side-by-side representation of the individual positions of the parallelogram-like structure 20 that due to the special configuration of this parallelogram-like structure 20, the filled bag is transferred by means of gripper device 6 of the transfer device 4 approximately on a line or approximately rectilinearly to the bag removal 3.

FIGS. 29 to 33 show a further exemplary embodiment of a packing machine 1 according to the invention. In this case, the configuration of this exemplary embodiment substantially corresponds to the exemplary embodiment already described.

In particular, the bag supply 2, the transfer device 4 and the bag removal 3 are arranged in a line 12. In contrast to the exemplary embodiment shown previously, not just one filling module 100 is pulled out of the line 12 and arranged next to the transfer device 4 but two filling modules 100 are arranged side by side outside the line 12.

In order to select which of the two filling modules 100 is used, in the exemplary embodiment shown here the transfer device 4 is provided to be movable so that this can be arranged either in front of one or the other filling module 100. For example, a quick product change or maintenance of a filling module 100 can be carried out, for which the transfer device 4 can be pushed or moved in front of the filling module 100 to be used or not to be maintained.

At the same time as the transfer device 4 can be displaced in the line 12, depending on the configuration, a movability or a displaceability of the transfer device 4 transverse to the line 12 can also be provided as in the exemplary embodiments shown previously.

In order to ensure a reliable picking up of bags from the bag supply 2 and a reliable delivery of the filled bags by the transfer device 4 to the bag removal 3, the individual components of the transfer device 4 can accordingly be provided to be displaceable.

Depending on the configuration, however, the bag supply 2 and/or the bag removal 3 can also be co-displaced so that there are always optimal distances between the individual assemblies.

Figure 34:
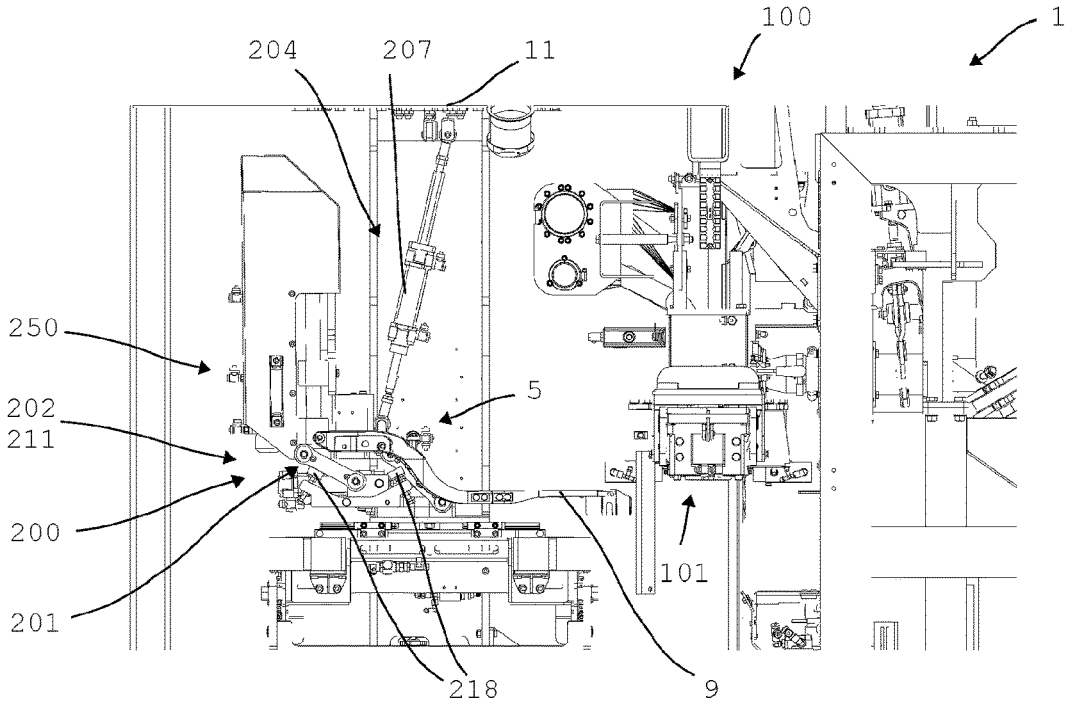
FIG. 34 shows a purely schematic view of an exemplary embodiment of a displacement device according to the invention viewed from the side.

FIG. 34 shows purely schematically in a side view a displacement device 200 according to the invention which is integrated in the packing machine according to the invention. In this case, a handling device 250 is accommodated on the displacement device which in the exemplary embodiment shown is the gripper device 5. In the exemplary embodiment shown here the gripper device 5 comprises two gripper arms 9 by means of which an empty bag can be retrieved from the bag production 13 and supplied to the filling nozzle 101 of the filling module 100.

In the exemplary embodiment shown here the displacement device 200 comprises an articulation mechanism 201 and a pre-loading device 204, wherein the handling device 250 can be displaced by means of the articulation mechanism 201 from a first position 202 or a basic position 211 into a second position 203 or an extended position 212.

In the exemplary embodiment shown here, the pre-loading device 204 is arranged above the articulation mechanism 201 or the handling device 250 and here comprises a pneumatic device 207 with a pneumatic cylinder 213.

Depending on the configuration, the displacement device 200 can also be connected exclusively from below to the articulation mechanism 201 or the handling device 250.

The pre-loading device 204 is here connected at the upper free end in an articulated manner to the housing device 11, wherein the other end in the exemplary embodiment shown is connected in an articulated manner to the articulation mechanism 201.

Figure 35:
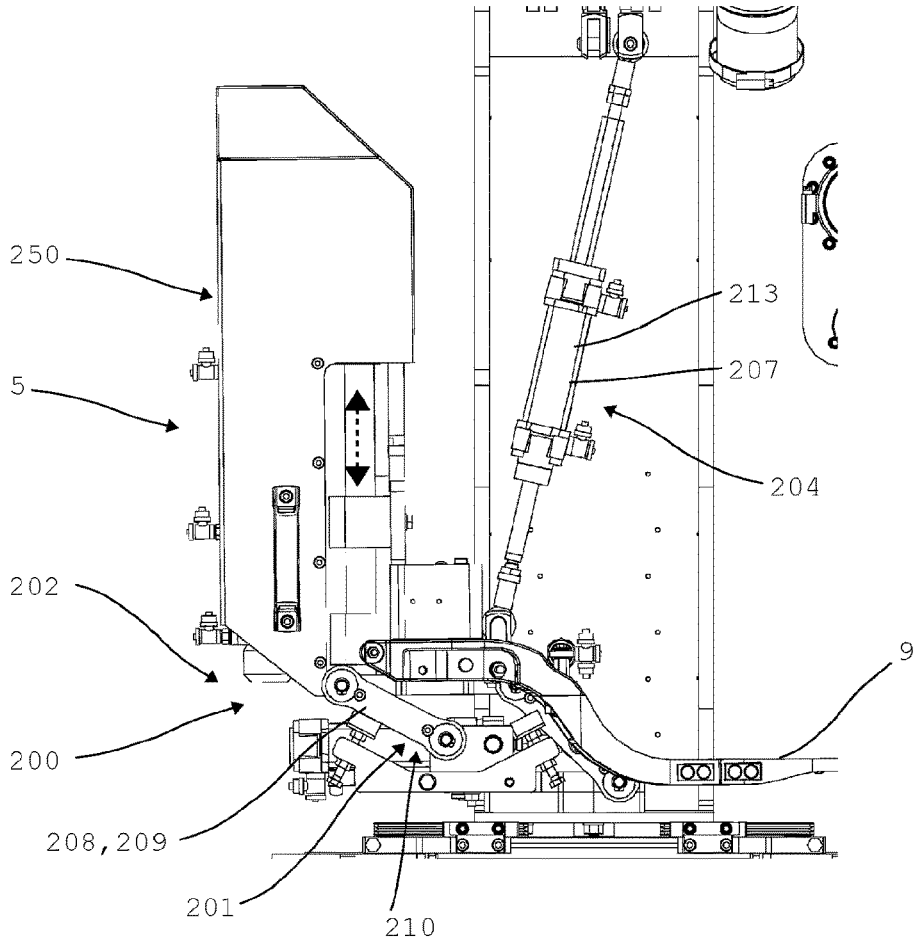
FIG. 35 shows an enlarged diagram of the exemplary embodiment according to FIG. 34.

FIG. 35 shows an enlarged diagram of the displacement device 200 according to the invention in the first position 202 according to FIG. 34 from the side.

In the exemplary embodiment shown here it is indicated by means of the dashed double arrow that the gripper device 5 or the gripper arms 9 are provided in a height-adjustable manner so that the gripper arms 9 can be moved up and down, in particular in order to attached the bag to the filling nozzle 101.

In addition, it can be seen that the articulation mechanism 201 is configured as a coupling gear or coupler 208 or four-link chain or four connector linkage 209, whereby a particularly suitable displacement of the handling device 250 is made possible.

The pre-loading device 204 is provided in this case to intercept the weight of the handling device 250 and the articulation mechanism 201 so that a particularly smooth and uniform displacement of the coupling gear or the four-link chain 209 can be accomplished wherein most of the weight is intercepted by the pre-loading device 204 or in the exemplary embodiment shown here, by the pneumatic device 207 or the pneumatic cylinder 213.

Thus, it is in particular possible to move the handling device 250 by hand and/or pneumatically and/or also by motor in a smooth manner. It is in particular possible to execute an actuator device 210 not shown in detail in the figures to be relatively small and in particular smaller than in conventional displacement devices 200. Then, for example a motor device or a motor and/or a pneumatic device or at least one pneumatic cylinder can be provided suitably dimensioned.

Figure 36:
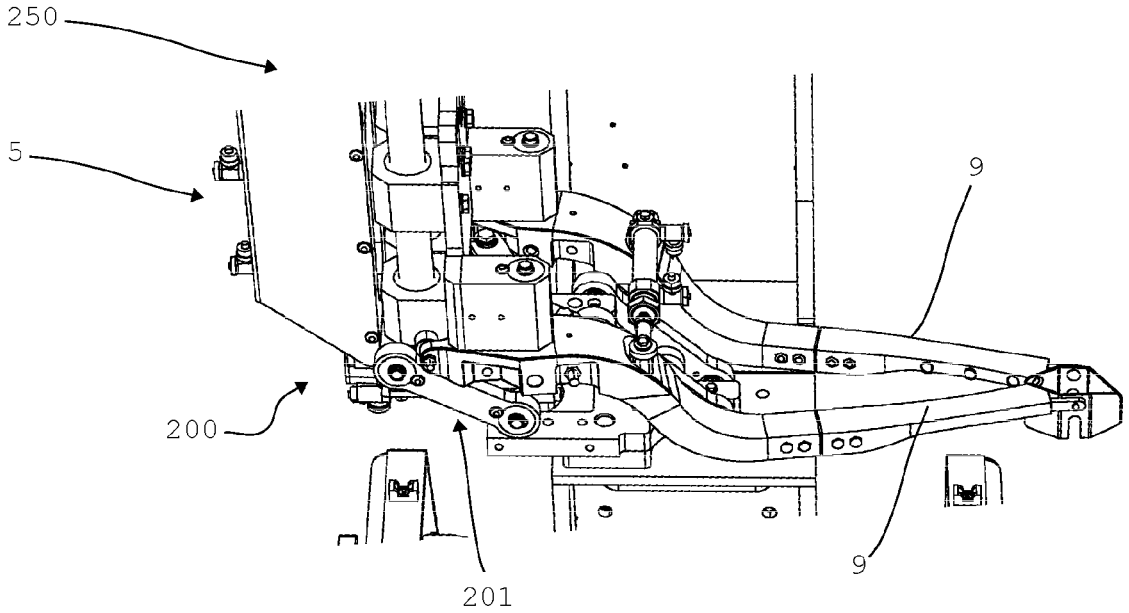
FIG. 36 shows a purely schematic diagram of an exemplary embodiment of a displacement device according to the invention in perspective view.
Figure 37:
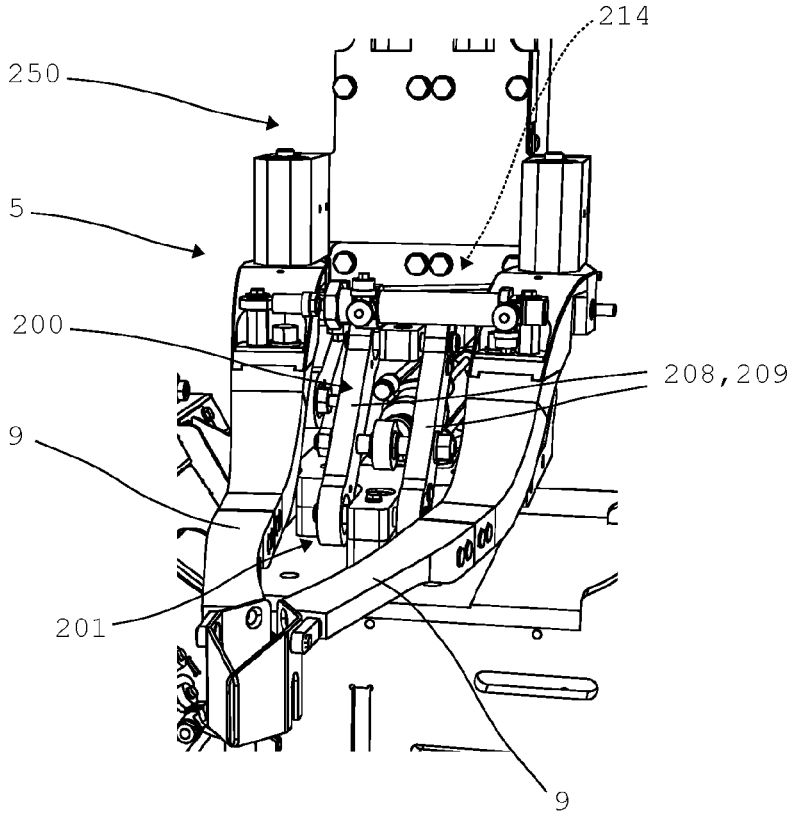
FIG. 37 shows a purely schematic diagram of the exemplary embodiment according to FIG. 36 in another perspective view.

FIGS. 36 and 37 show in two different perspective views an exemplary embodiment of a displacement device 200 according to the invention without pre-loading device 204.

It can also be seen here that the handling device 250 or the first gripper device 5 with its two gripper arms 9 is arranged on the articulation mechanism 201.

Figure 38:
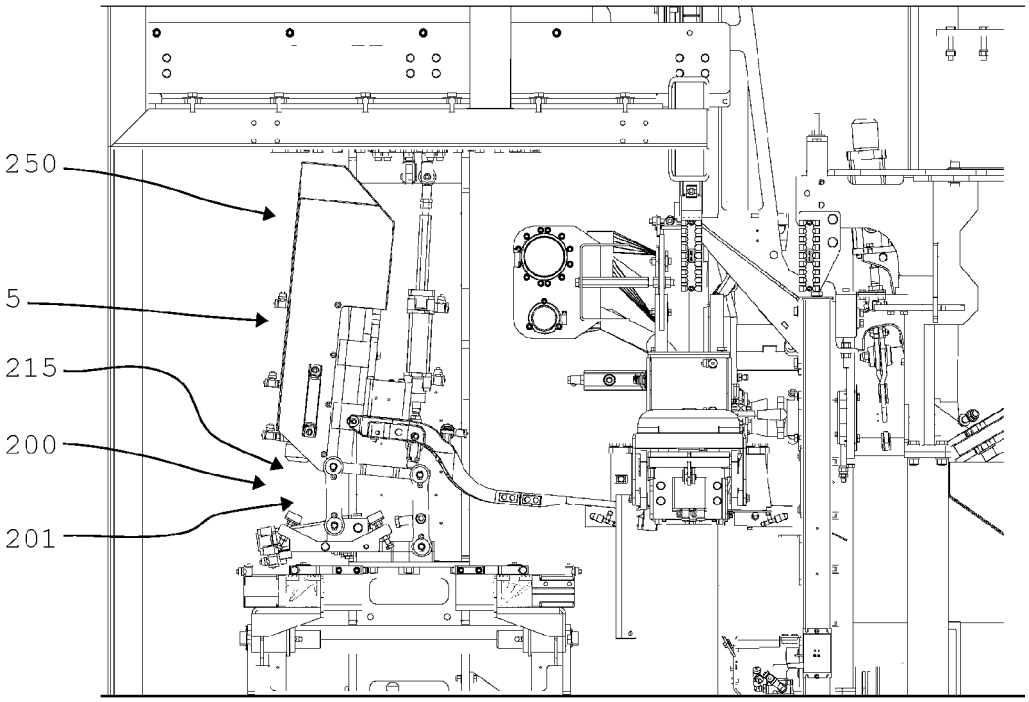
FIG. 38 shows a purely schematic diagram of an exemplary embodiment of a displacement device according to the invention viewed from the side.

It can be clearly seen in FIG. 37 that the articulation mechanism 201 in the exemplary embodiment shown here comprises two coupling gears 208 arranged in parallel or four-link chains 209 which are connected together or synchronized. FIG. 38 shows a displacement device 200 according to the invention wherein the articulation mechanism 201 is located in an intermediate position 215 here.

Figure 39:
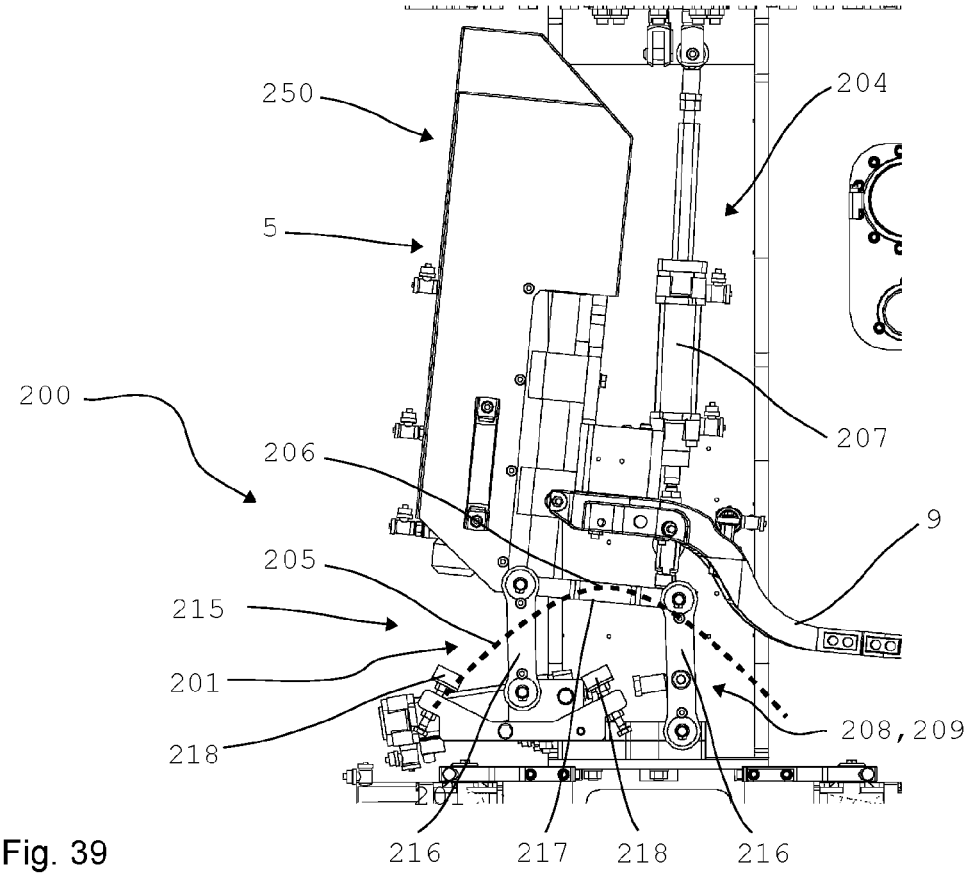
FIG. 39 shows an enlarged view of the exemplary embodiment according to FIG. 38.

An enlarged diagram of the displacement device 200 according to FIG. 38 is shown purely schematically in FIG. 39. In this case, it is indicated purely schematically by the dashed line in FIG. 39 that the articulation mechanism 201 or the coupling gear 208 or the four-link chain 209 moves along an arcuate path 205 so that the handling device 250 is also displaced in an arcuate or approximately circular or approximately semi-circular movement. In this case, the individual links 216 and the coupler 217 of the coupling gear 208 or the four-link chain 209 can be seen particularly clearly in FIG. 39.

In the exemplary embodiment shown here of a displacement device 200 the pre-loading device 204 or the pneumatic device 207 or the pneumatic cylinder 213 are configured in such a manner that the effect of the pre-loading effect is minimal at the apex 206 of the arcuate path 205.

In this case, the links 216 of the coupling gear 208 are substantially vertical in this position so that the handling device 250 in this position rests substantially unloaded on the links 216 or is supported by these with the result that an unloading is achieved and a minimal effect of the pre-loading device 204 is harmless.

In the end positions or in the first position 202 and/or the second position 203 the effect of the pre-loading device 204 can be maximal and/or delimit the movement so that a type of stop is formed.

In the exemplary embodiment shown however, buffers 218 are provided on which in the exemplary embodiment shown here the left links 216 or the articulation mechanism 201 rest in the end positions.

Figure 40:
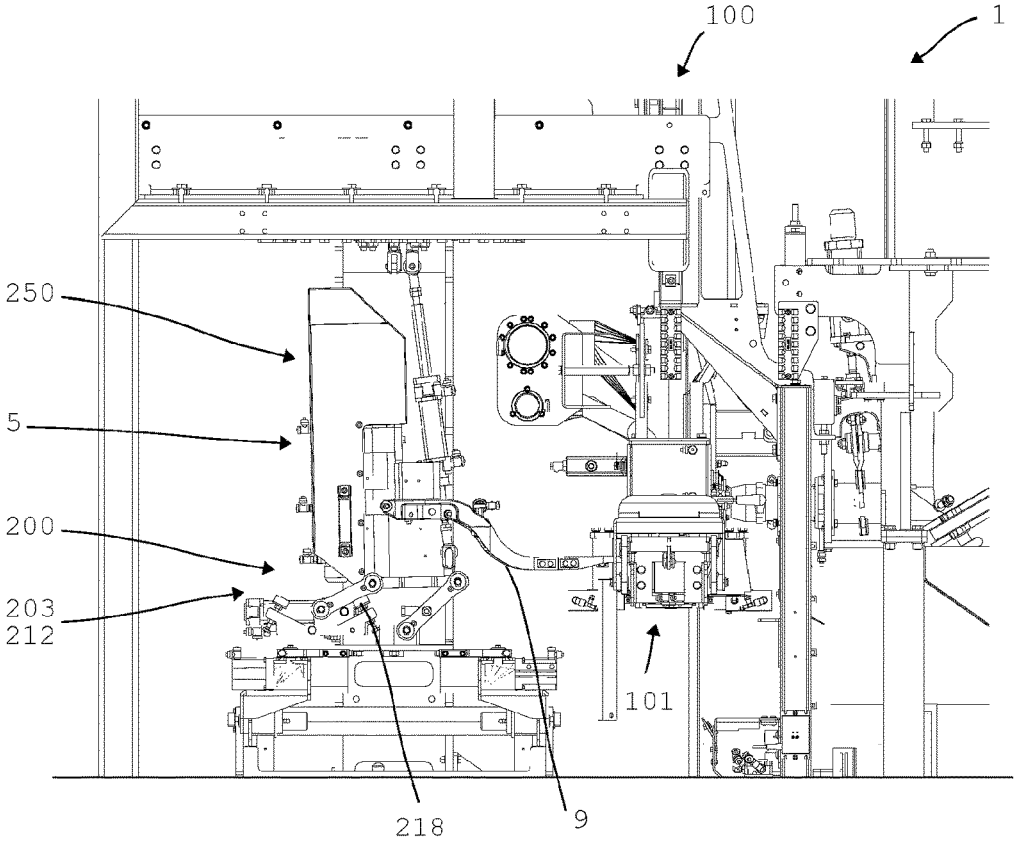
FIG. 40 shows a purely schematic diagram of an exemplary embodiment of a displacement device according to the invention viewed from the side.
Figure 41:
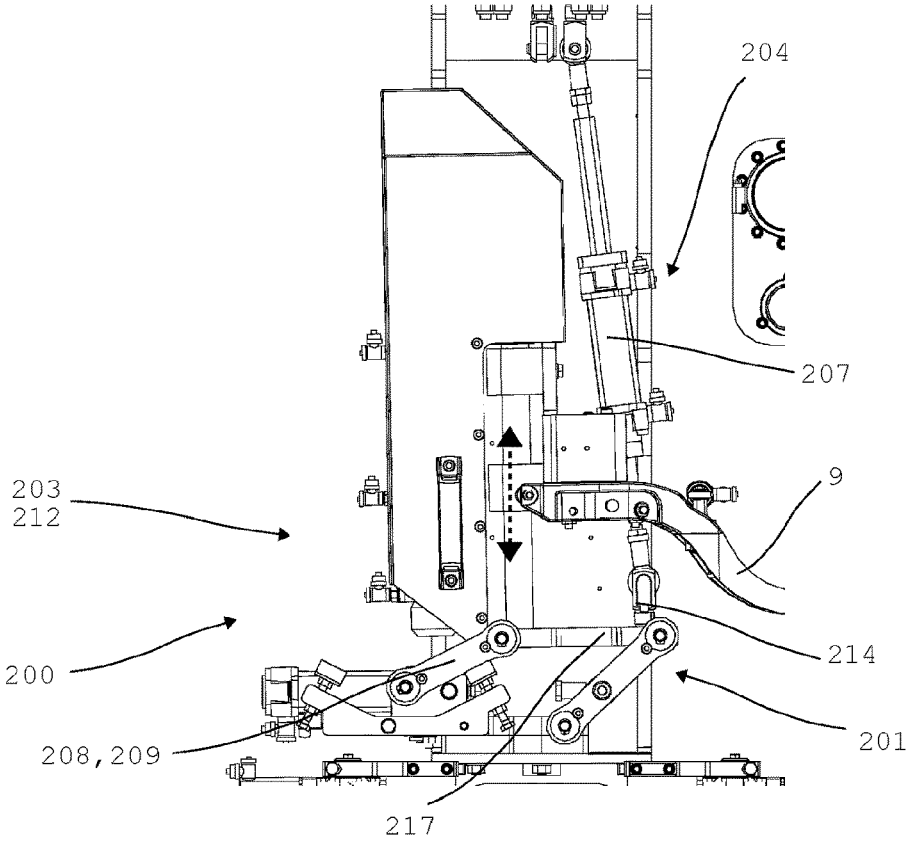
FIG. 41 shows an enlarged diagram of the exemplary embodiment according to FIG. 40.

FIGS. 40 and 41 show an exemplary embodiment of a displacement device 200 according to the invention with the handling device 250 received thereon or the gripper device 5 with the gripper arms 9 in the other end position, namely the second position 203 or the extended position 212, in a side view and an enlarged diagram.

In this position the left link 216 of the coupling gear 208 rests on the right buffer 218. Then, the handling device 250 is moved completely to the right so that in the exemplary embodiment shown here, the gripper device 5 or the gripper arms 9 can attach an empty bag to the filling nozzle 101.

Here it can additionally be seen that in the exemplary embodiment shown here, the pre-loading device 204 acts at the position 214 between the two coupling gears 208 or four-link chains 209. To this end the pneumatic device is here attached to a support between the two couplers 217 of the two coupling gears 208.

Depending on the configuration, the weight of the filled bag during removal of the bag from the filling nozzle 101 can be intercepted by the pre-loading device 204. In the exemplary embodiment shown here however, the full bag is removed from the second gripper device 6, then closed and supplied to the bag removal or the conveyor belt 16.

In particular, it is achieved by the displacement device 200 according to the invention that the movement of the handling device 250 and in this case of the first gripper device 5 can take place substantially relieved of load since the weight of the handling device 250 is intercepted or unloaded by the pre-loading device 204 and the special configuration of the articulation mechanism 201.

While particular embodiments of the present displacement device and method for displacement have been described herein, it will be appreciated by those skilled in the art that changes and modifications may be made thereto without departing from the invention in its broader aspects and as set forth in the following claims.

REFERENCE LIST

1 Packing machine
2 Bag supply
3 Bag removal
4 Transfer device
5 First gripper device
6 Second gripper device
7 Side
8 Side
9 Gripper arm
10 Clamping device
11 Housing device
12 Line
13 Bag production
14 Film supply
15 Closure device
16 Conveyor belt
17 Housing cover
18 Base body
19 Rail
20 Parallelogram-like structure
21 Welding station
50 Cleaning apparatus
51 Blowing strip
52 First nozzle device
53 Second nozzle device
54 Third nozzle device
55 Blowing-out direction
56 Blowing-out direction
57 Blowing-out direction
58 Control device
59 Air supply
59*a* Air supply
60 Row
61 Row
62 Row
63 Suction device
64 Housing device
65 Housing element
66 Flap
67 Opening
68 Suction pipe
69 Cover
100 Filling module
101 Filling nozzle
102 Housing device
103 Housing cover
104 Inlet hopper
105 Air filling module
106 Pressure chamber
200 Displacement device
201 Articulation mechanism
202 First position
203 Second position
204 Pre-loading device
205 Arcuate path
206 Apex
207 Pneumatic device
208 Coupling gear
209 Four-link chain
210 Actuator device, pneumatic cylinder
211 Basic position
212 Extended position
213 Pneumatic cylinder
214 Position
215 Intermediate position
216 Link
217 Coupler
218 Buffer
250 Handling device

The invention claimed is:

1. A packing machine comprising:

at least one handling device having at least one gripper arm; and a displacement device, comprising:

at least one articulation mechanism on which the at least one handling device is accommodated, wherein the at least one handling device is displaceable along an arcuate path by means of the at least one articulation mechanism between at least one first position and at least one second position; and at least one pre-loading device in operative connection with at least one of the at least one articulation mechanism and the at least one handling device in order to unload the weight of the at least one articulation mechanism and/or the at least one handling device during displacement of the at least one handling device along the arcuate path between the at least one first position and the at least one second position, said at least one pre-loading device being one of a pneumatic device and a spring, at least part of said at least one pre-loading device being located entirely above the at least one articulation mechanism, and at least a portion of the at least one handling device being disposed entirely above the at least one articulation mechanism at all times.

2. The packing machine according to claim 1, wherein the at least one pre-loading device is received by the packing machine in an articulated manner.

3. The packing machine according to claim 1, wherein the at least one pre-loading device has minimal effect at an apex of the arcuate path.

4. The packing machine according to claim 1, wherein the at least one pre-loading device comprises the pneumatic device.

5. The packing machine according to claim 1, wherein a maximum deflection of the at least one pre-loading device defines at least one stop for the displacement of the at least one handling device.

6. The packing machine according to claim 1, wherein the at least one articulation mechanism is configured as a coupler.

7. The packing machine according to claim 1, wherein the at least one articulation mechanism comprises at least one four connector linkage.

8. The packing machine according to claim 1, wherein the at least one handling device is configured as a gripper device with the at least one gripper arm, and wherein the at least one gripper arm is received in a height-adjustable manner on the gripper device.

9. The packing machine according to claim 1, wherein at least one actuator device is provided for the displacement of the at least one handling device.

10. A method of displacing at least one handling device of a packing machine according to claim 1, the method comprising the step of:

at least partially unloading the weight of the at least one handling device by means of the displacement device during displacement of the at least one handling device between the at least one first position and the at least one second position so that a continuous and reduced application of force is required to move the at least one handling device.

* * * * *